US011619403B2

(12) United States Patent
Nakagawa

(10) Patent No.: US 11,619,403 B2
(45) Date of Patent: Apr. 4, 2023

(54) CEILING-EMBEDDED AIR CONDITIONER

(71) Applicant: FUJITSU GENERAL LIMITED, Kanagawa (JP)

(72) Inventor: Hirofumi Nakagawa, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 87 days.

(21) Appl. No.: 17/042,471

(22) PCT Filed: Mar. 15, 2019

(86) PCT No.: PCT/JP2019/010750
§ 371 (c)(1),
(2) Date: Sep. 28, 2020

(87) PCT Pub. No.: WO2019/188382
PCT Pub. Date: Oct. 3, 2019

(65) Prior Publication Data

US 2021/0010687 A1 Jan. 14, 2021

(30) Foreign Application Priority Data

Mar. 30, 2018 (JP) ..... JP2018-069368

(51) Int. Cl.
*F24F 1/0047* (2019.01)
*F24F 13/10* (2006.01)
*F24F 13/20* (2006.01)

(52) U.S. Cl.
CPC ..... *F24F 1/0047* (2019.02); *F24F 13/10* (2013.01); *F24F 13/20* (2013.01)

(58) Field of Classification Search
CPC ..... F24F 1/0011; F24F 1/0014; F24F 1/0047; F24F 1/52; F24F 13/065; F24F 13/08; F24F 13/10; F24F 13/20; F24F 2013/0612
See application file for complete search history.

(56) References Cited

U.S. PATENT DOCUMENTS

2013/0284417 A1* 10/2013 Taira ..... F24F 11/70 454/256
2016/0273800 A1* 9/2016 Erturk ..... F24F 13/065

FOREIGN PATENT DOCUMENTS

EP 3187793 A1 * 7/2017 ..... F24F 1/0007
JP H0762556 B2 * 7/1995
JP 2004116977 A * 4/2004

* cited by examiner

*Primary Examiner* — Edelmira Bosques
*Assistant Examiner* — Michael James Giordano
(74) *Attorney, Agent, or Firm* — Paratus Law Group, PLLC

(57) ABSTRACT

In order to enable a uniform air-conditioning of the entire room, a fixed air blowing portion 75 and movable air blowing portions 77 on both sides thereof are provided on a decorative panel 70 as an air blowing part 74, and the movable air blowing portions 77 can rotate about an axis orthogonal to the panel surface or the ceiling surface of the decorative panel 70.

5 Claims, 17 Drawing Sheets

(a)

(b)

(a)

(b)

(a)

(b)

CEILING-EMBEDDED AIR CONDITIONER

CROSS REFERENCE TO PRIOR APPLICATION

This application is a National Stage Patent Application of PCT International Patent Application No. PCT/JP2019/010750 (filed on Mar. 15, 2019) under 35 U.S.C. § 371, which claims priority to Japanese Patent Application No. 2018-069368 (filed on Mar. 30, 2018), which are all hereby incorporated by reference in their entirety.

TECHNICAL FIELD

The present invention relates to a ceiling-embedded air conditioner, and more particularly to the structure of an indoor unit.

BACKGROUND ART

In a ceiling-embedded air conditioner, an outdoor unit installed outdoors and an indoor unit installed in a ceiling of an air conditioning room are connected by a gas pipe and a liquid pipe to form a refrigerant circuit. The indoor unit has a box-shaped main unit that is buried in the ceiling back space, and a decorative panel that is disposed on the air conditioning room side of the ceiling and attached to the main unit.

As an example, in the invention described in Patent Literature 1, a U-shaped heat exchanger in the main unit, and a blowing fan formed of a sirocco fan surrounded by a fan casing in the center of the heat exchanger are provided. The decorative panel has a blowing opening at the center and suction openings along three sides below the heat exchanger.

Then, the air sucked from the suction opening can exchange heat with the refrigerant in the heat exchanger and can be blown out in one direction from the blowing opening. By surrounding the blowing fan with the heat exchanger, the distance between the blowing fan and the surface of the heat exchanger is almost constant, and there is little bias in the wind speed and air volume of the air passing through the heat exchanger. The heat exchanger is used effectively so that the heat exchange can be performed with efficiency.

CITATION LIST

Patent Literature

PATENT LITERATURE 1: JP-A-2000-213767

SUMMARY OF INVENTION

Problems to be Solved by Invention

Normally, the left/right airflow direction vane and the up/down airflow direction vane are provided at the air blowing opening, but since the air blowing opening itself is a fixed air blowing opening, even if the airflow direction vane is moved, the air blowing range is one direction that the air blowing opening faces, and it is difficult to air-condition the entire room.

Therefore, an object of the invention is to provide a ceiling-embedded air conditioner capable of blowing conditioned air over a wide range so that a room can be uniformly air-conditioned.

Solution to Problems

In order to solve the above-mentioned problem, the invention provides a ceiling-embedded air conditioner which includes a box-shaped main unit that includes an air blower and a heat exchanger and is disposed in a ceiling back space, and a decorative panel that is attached to a bottom surface of the main unit so as to be included along a ceiling surface. The decorative panel is provided with an air suction part disposed on an air suction side of the air blower and an air blowing part disposed on an air sending side of the air blower. The air blowing part is formed with a fixed air blowing portion that includes a first air blowing opening for blowing air toward a specific side of the decorative panel and movable air blowing portions that include a second air blowing opening and are disposed on both sides of the fixed air blowing portion. The movable air blowing portion is rotatable within a predetermined angle range about an axis orthogonal to a panel surface of the decorative panel or the ceiling surface. According to the rotation of the movable air blowing portion, the second air blowing opening can be directed in a predetermined direction between a first position facing a specific side of the decorative panel and a second position facing another side surface adjacent to the specific side.

Effects of Invention

According to the invention, the movable air blowing portions are disposed on both sides of the fixed air blowing portion, and the movable air blowing portions can rotate in a predetermined angle range about an axis orthogonal to the panel surface or the ceiling surface of the decorative panel. By blowing out conditioned air over a wide range, the air conditioning room can be air-conditioned uniformly.

DESCRIPTION OF EMBODIMENTS

Hereinafter, some modes for carrying out the invention will be described in detail as embodiments based on the accompanying drawings. The invention is not limited to this.

An air conditioner according to the invention is a refrigerant circuit in which an outdoor unit (not illustrated) installed outdoors and an indoor unit 1 attached to a ceiling T1 of an air conditioning room R are connected by a gas pipe and a liquid pipe (both not illustrated).

Figure 1:
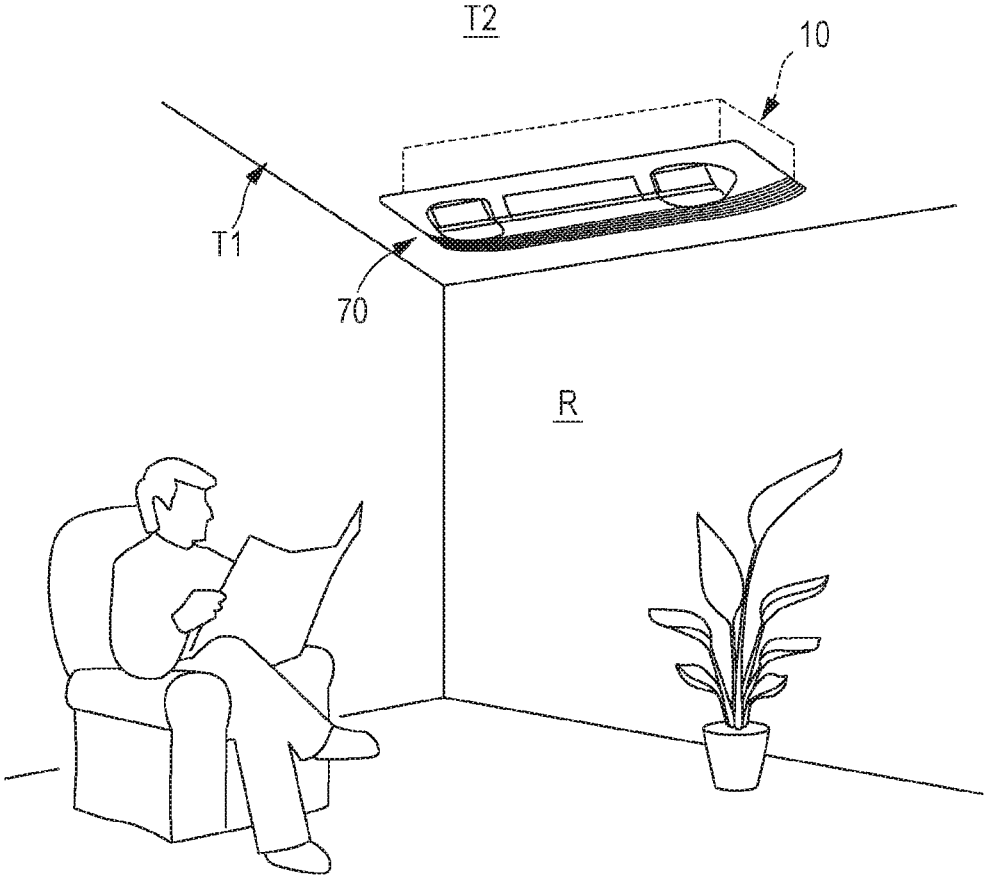
FIG. 1 is an explanatory view illustrating an installed state of a ceiling-embedded air conditioner according to the invention.
Figure 2:
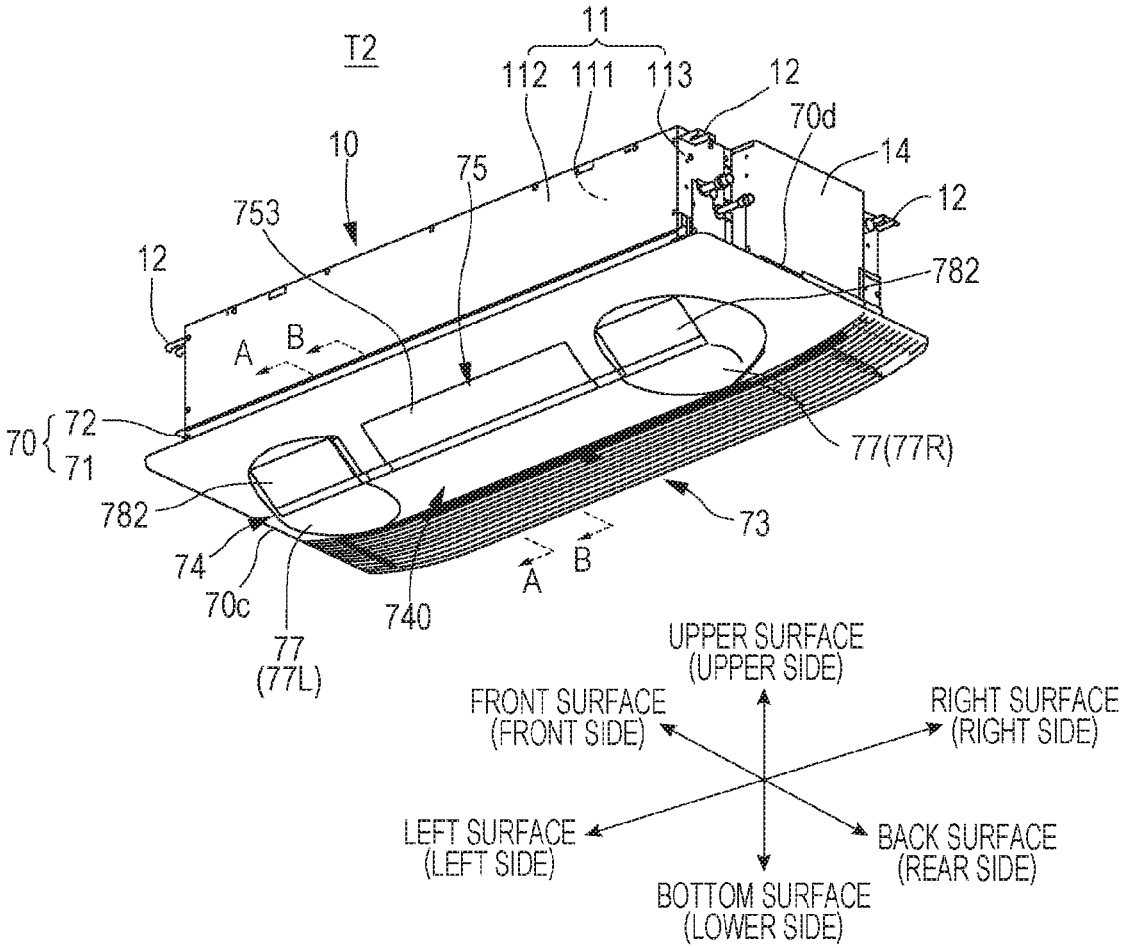
FIG. 2 is a perspective view illustrating the ceiling-embedded air conditioner.

An indoor unit 1 illustrated in FIGS. 1 and 2 is a ceiling-embedded air conditioner that includes a box-shaped main unit 10 embedded in a ceiling back space T2 and a decorative panel 70 that is disposed on the air conditioning room R side of the ceiling T1 and attached to a bottom surface of the main unit 10, and particularly is an omnidirectional blow-out type ceiling-embedded air conditioner that blows out the air in all directions.

Figure 3:
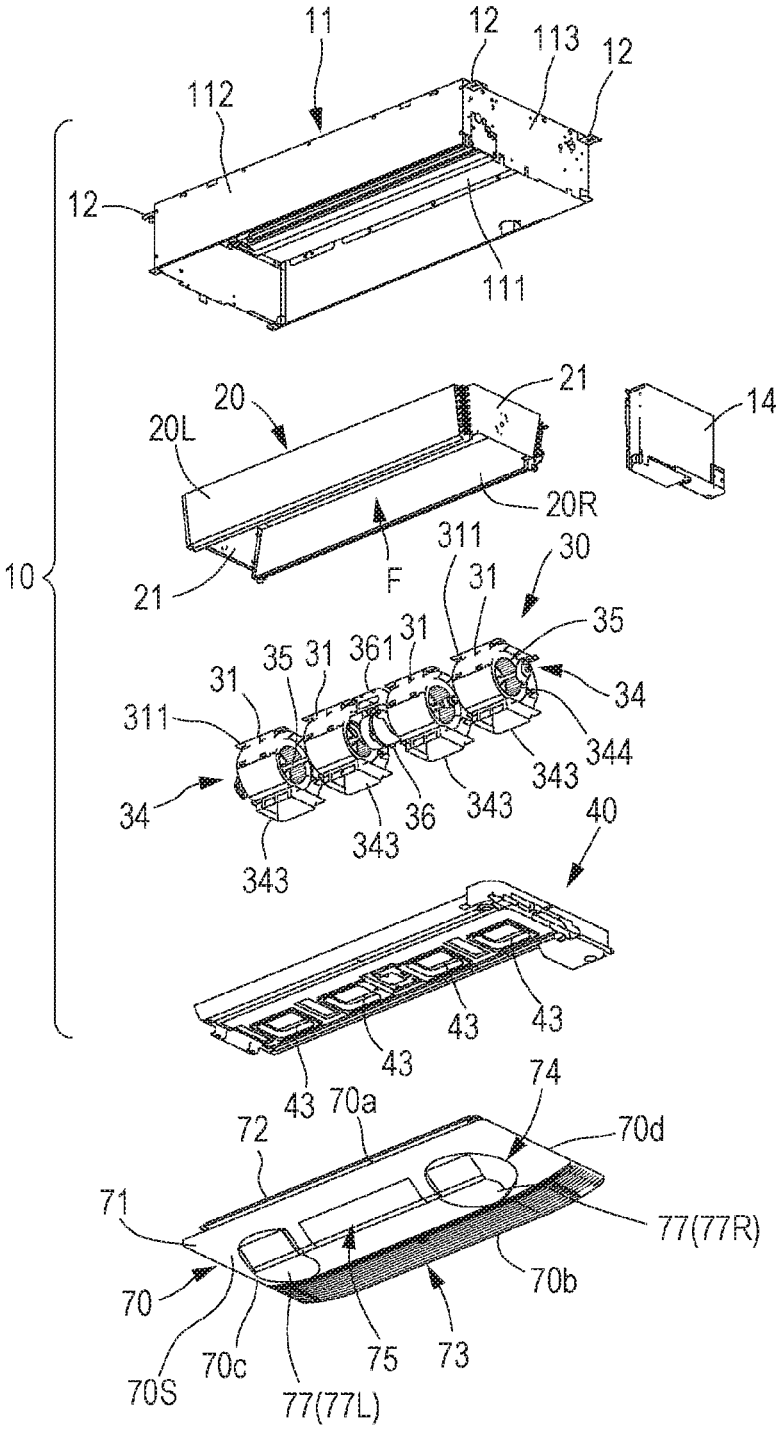
FIG. 3 is an exploded perspective view of the ceiling-embedded air conditioner.

With reference to FIG. 3, the main unit 10 has a rectangular top plate 111 formed of sheet metal, and a box-shaped outer trunk 11 formed of side plates 112 and 113 extending downward from four sides of the top plate 111. The side plate on the long side of the top plate 111 is the side plate 112 and the side plate on the short side is the side plate 113, and two mounting brackets 12 are fixed to each of the two side plates 113 facing each other.

The main unit 10 is installed on the ceiling back space T2 by suspending the mounting bracket 12 with a plurality of hanging bolts (not illustrated) fixed to the ceiling back space T2.

The decorative panel 70 includes a panel portion 71 in a rectangular shape larger than the top plate 111, and a side wall 72 which is erected from the rear surface of the panel portion 71 to the main unit 10 side and attached to the opened bottom surface of the box-shaped outer trunk 11.

The panel portion 71 includes an air suction part 73 that is opened in a square shape on one side 70*b* located on the rear side among the facing long sides, and an air blowing part 74 on another side 70*a* that exists in front of the long side facing the side 70*b*.

In the indoor unit 1 in FIG. 2, the top plate 111 direction will be described as the upper surface or the upper side, the air conditioning room R direction as the bottom surface or the lower side, the air blowing part 74 side as the front surface or the front side, and the air suction part 73 side as the back surface side or the rear side, the left short side 70*c* side as the left surface or the left side, and the right short side 70*d* side as the right surface or the right side. The same applies to each component.

Figure 10:
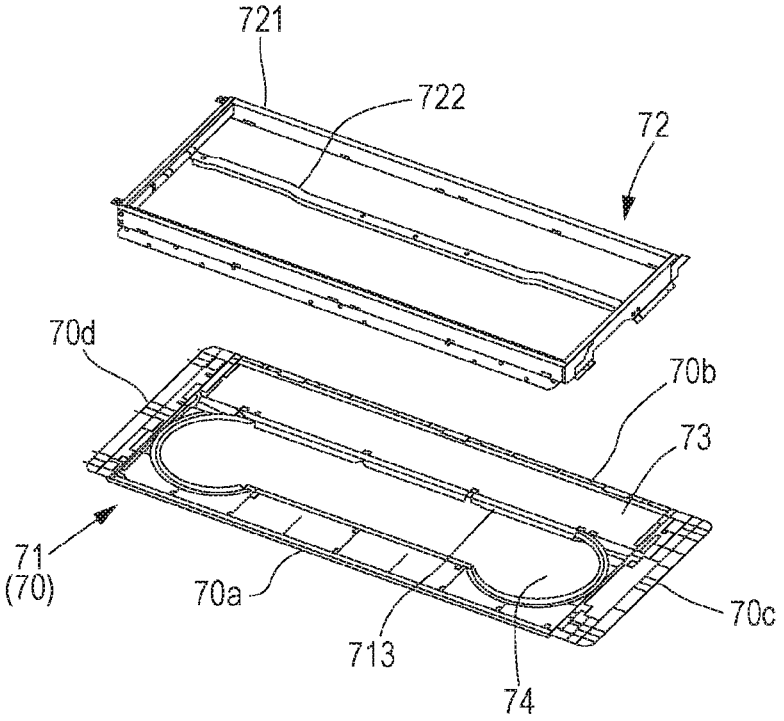
FIG. 10(*a*) is a perspective view illustrating a decorative panel and a frame separately, and FIG. 10(*b*) is a perspective view illustrating a packaging state of the decorative panel.
Figure 10:
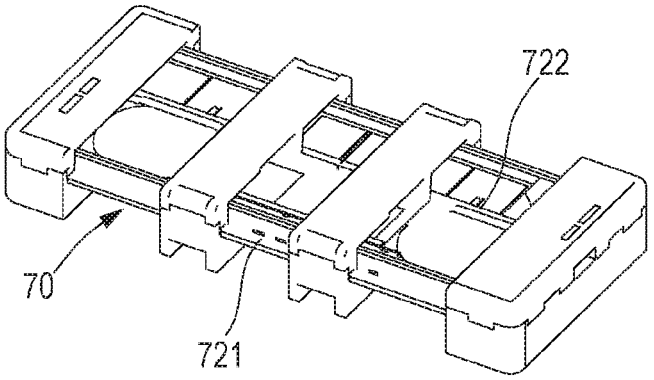

As illustrated in FIG. 10(*a*), the side wall 72 includes a frame 721 which is formed in a rectangular shape along the respective sides (the long sides 70*a* and 70*b* and the short sides 70*c* and 70*d*) of the panel portion 71 with a size surrounding the air suction part 73 and the air blowing part 74, and a beam 722 which is suspended between the short sides (sides on the short sides 70*c* and 70*d* side of the panel portion 71) of the frame 721. The side wall 72 is screwed integrally to the rear surface of the panel portion 71.

Both the frame 721 and the beam 722 are made of sheet metal, and the beam 722 is disposed on a partition portion 713 formed between the air suction part 73 and the air blowing part 74 of the panel portion 71.

According to this, as illustrated in FIG. 10(*b*), when the decorative panel 70 is packed, the protruding piece on the packing material presses the beam 722, so that it is possible to prevent damage due to impact such as dropping. Further, with the beam 722, the structure can withstand a load applied in a direction parallel to a panel surface 70S of the decorative panel 70.

Further, the beam 722 may be suspended between the long sides 70*a* and 70*b* of the frame 721 depending on the shapes and arrangements of the air suction part 73 and the air blowing part 74 and the like.

Outer Trunk

Next, the components housed in the main unit 10 will be described with reference to FIGS. 3 to 6. On the inner surface of the top plate 111 of the outer trunk 11, a heat insulating material 13 made of styrene foam having a large plate thickness is provided.

A thin heat insulating sheet (not illustrated) may be provided on the inner surfaces of the side plates 112 and 113 of the outer trunk 11 without providing the heat insulating material 13. The center of the heat insulating material 13 is opened, and a part of the top plate 111 is exposed when viewed from below. A heat exchanger 20 and a fan unit 30 are fixed to the top plate 111 of this exposed portion.

As illustrated in FIG. 2, an electrical equipment box 14 accommodating electric components (not illustrated) for controlling the indoor unit 1 is attached to the outer surface of the right surface of the outer trunk 11.

Heat Exchanger

Figure 4:
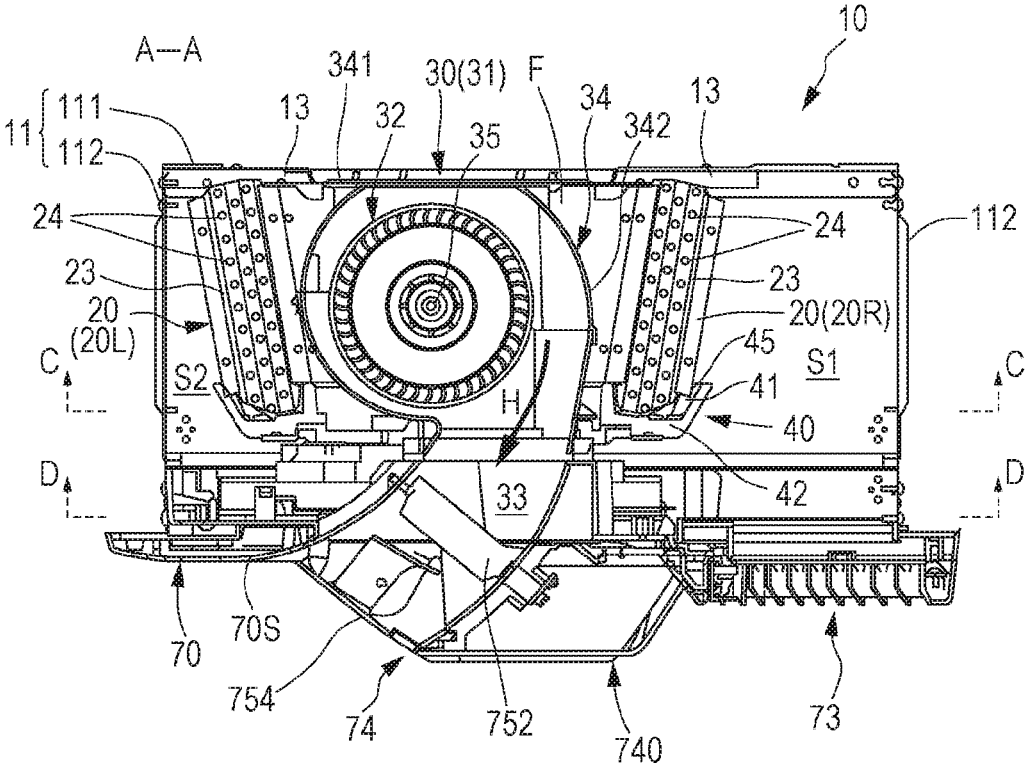
FIG. 4 is a schematic cross-sectional view taken along the line A-A of FIG. 2.
Figure 5:
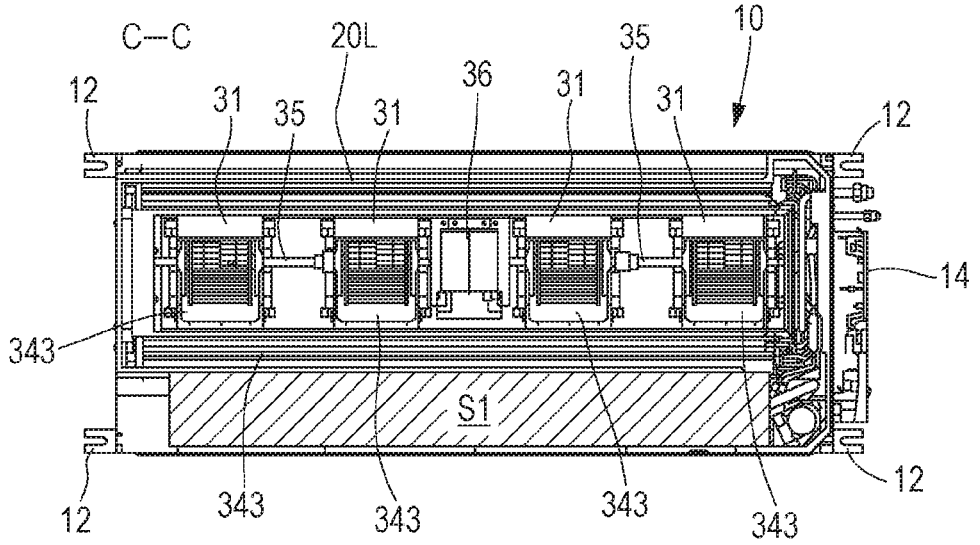
FIG. 5 is a schematic cross-sectional view taken along the line C-C of FIG. 4.

The heat exchanger 20 includes a plurality of strip-shaped aluminum fins 23 disposed in parallel, and two heat exchange parts of a front heat exchange part 20L on the left side in FIG. 4 and a rear heat exchange part 20R on the right side in FIG. 4 which are separated from each other and in a fin-tube shape formed by the plurality of heat transfer tubes 22 passing through the aluminum fins 23.

The front heat exchange part 20L and the rear heat exchange part 20R is disposed to face each other, but are preferably combined in a V shape such that the gap on the upper end side becomes wider than the gap on the lower end side as illustrated in FIG. 4 in order to suppress the height dimension to be low and to increase the amount of ventilation. Instead of the V shape, these parts may be disposed in an inverted V shape in which the gap on the upper end side is narrower than the gap on the lower end side.

In any case, the left and right ends of the front heat exchange part 20L and the rear heat exchange part 20R are connected by a connecting plate 21, and the space inside the heat exchanger 20 becomes an air blowing chamber F. The bottom surface of the heat exchanger 20 (the surface between the lower ends of the front heat exchange part 20L and the rear heat exchange part 20R) is closed by a drain pan 40 described later.

Further, in the gap between the heat exchanger 20 and the outer trunk 11, a first air suction chamber S1 is provided between the outer trunk 11 and the rear heat exchange part 20R, and a second air suction chamber S2 is provided between the outer trunk 11 and the front heat exchange part 20L. The first air suction chamber S1 is disposed directly above the air suction part 73, and the second air suction chamber S2 communicates with the air suction part 73 via an air guide path L described later.

Blowing Fan

The fan unit 30 is disposed in the air blowing chamber F provided inside the heat exchanger 20. The fan unit 30 includes a sirocco fan type blowing fan 31, a fan motor 36, a fan mounting base 311 (see FIG. 3) for supporting the blowing fan 31 and fixing it to the top plate 111, and a motor mounting base 361 (see FIG. 3) for fixing the fan motor 36 to the top plate 111.

The blowing fan 31 includes a cylindrical impeller 32 having a plurality of blades, a spiral fan casing 34 that contains the impeller 32, and a rotating shaft 35 that is connected to the center of the impeller 32.

Any number of the blowing fans 31 may be selected according to the air conditioning capacity. In this embodiment, four fans) are coaxially disposed side by side. The blowing fans 31 have the same structure.

In the fan unit 30, after the fan motor 36 is fixed to the top plate 111 by the motor mounting base 361, two blowing fans 31 are connected to each other at both ends of the fan motor 36 by the rotating shafts 35. Both ends of the rotating shaft 35 are fixed to the top plate 111 via bearing plates (not illustrated) made of, for example, L-shaped metal fittings. Further, there is a fan fixing part 341 (see FIG. 4) also on the upper part of the fan casing 34, and this is fixed to the top plate 111 with a screw.

The fan casing 34 includes an accommodating part 342 that contains the impeller 32, and a cylindrical blower 343 that is formed continuously from the accommodating part 342 and extends downward below the lower end of the heat exchanger 20. A fan suction opening 344 that takes in air into the impeller 32 is opened in a circular shape on the side surface of the accommodating part 342.

The fan casing 34 may be divided into upper and lower parts in a plane parallel to the axial line of the impeller 32 so that the impeller 32 can be contained therein, or may be divided into left and right parts in a plane perpendicular to the axial line of the impeller 32. In the inside of the fan casing 34, the accommodating part 342 and the blower 343 continuously form a blowing path 33 for the blowing air H.

As described above, in this embodiment, since the fan unit 30 is disposed with the internal space surrounded by the heat exchanger 20 as the air blowing chamber F, when the impeller 32 of the blowing fan 31 rotates, the inside of the air blowing chamber F becomes negative pressure, and the air from the air suction part 73 passes through the front heat exchange part 20L and the rear heat exchange part 20R into the air blowing chamber F, and is sucked into the fan suction opening 344 to be blown out to the surroundings of the impeller 32. The blown air is blown in one direction along the blowing path 33 in the fan casing 34, and blown from the air blowing part 74 to the air conditioning room R.

Drain Pan

The drain pan 40 that receives drain water generated in the heat exchanger 20 is provided at the lower end of the heat exchanger 20. The drain pan 40 is integrally formed with a heat insulating member 41 made of styrene foam and a drain sheet 42 made of resin provided on the surface facing the heat exchanger 20.

The drain pan 40 is formed in a rectangular shape having a size that covers the opening surface on the lower end side of the heat exchanger 20, and is also a partition plate that separates the air blowing chamber F from the air guide path L described later. The drain pan 40 is provided with ventilation holes 43 into which the cylindrical blower 343 of the fan unit 30 is fitted, as many as the blowing fans 31 (4 holes in this embodiment).

As described above, the heat exchanger 20 has the front heat exchange part 20L and the rear heat exchange part 20R disposed in a V shape, and the bottom surface is narrower than the upper surface, so that the drain pan 40 becomes smaller by that amount. The area occupied by the drain pan 40 in the main unit 10 becomes small, the ventilation resistance due to the drain pan 40 also decreases, and the ventilation area around the drain pan 40 expands to improve ventilation efficiency.

On the drain sheet 42 side of the drain pan 40, a gutter 45 is provided to receive the drain water generated in the heat exchanger 20. Further, since the dew condensation water generated on the outer surface side of the fan casing 34 during the cooling operation is received by the bottom surface of the drain pan 40, it is preferable to perform waterproof treatment around the ventilation holes 43.

Although not illustrated, the drain pan 40 may be provided with a drain pump or a drain hose for draining drain water, a float switch for controlling on/off of the drain pump, and the like.

Decorative Panel

The configuration of the decorative panel 70 will be described with reference to FIGS. 11 to 13. The decorative panel 70 includes the air blowing part 74 on a side of the long side 70*a* and the air suction part 73 on a side of the other long side 70*b*. In the air blowing part 74, a part of the panel portion 71 is formed as a raised portion 740 that is raised in a trapezoidal cross-section shape toward the air conditioning room R along the long side 70*a*.

According to this embodiment, the raised portion 740 has an elliptical shape that is a rounded rectangular shape made up of two parallel lines of equal length and two semicircles, and has the side surface (circumferential surface) having an inclined surface. The raised portion 740 has a fixed air blowing portion 75 in the central portion, and movable air blowing portions 77L and 77R on both left and right sides. When it is not necessary to distinguish the movable air blowing portions 77L and 77R, they are collectively referred to as the movable air blowing portion 77.

Figure 16:
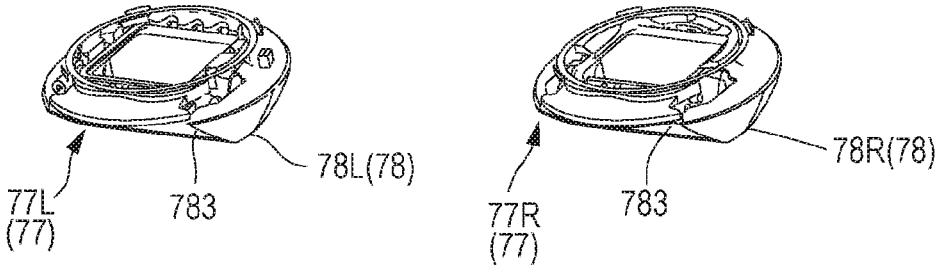
FIG. 16 is a perspective view illustrating a rotation unit attached to the partition plate unit.

Referring also to FIG. 16, the movable air blowing portion 77L includes a truncated cone-shaped rotation unit 78L which rotates within a predetermined angle range around an axial line orthogonal to the panel surface 70S of the decorative panel 70 or the surface of the ceiling T1. Similarly, the movable air blowing portion 77R also includes a truncated cone-shaped rotation unit 78R which rotates within a predetermined angle range around an axial line orthogonal to the panel surface of the decorative panel 70 or the surface of the ceiling T1.

Semi-circular portions are formed at both ends of the raised portion 740 by a part of the rotation units 78L and 78R. When it is not necessary to distinguish between the rotation units 78L and 78R, they are collectively referred to as the rotation unit 78.

Figure 13:
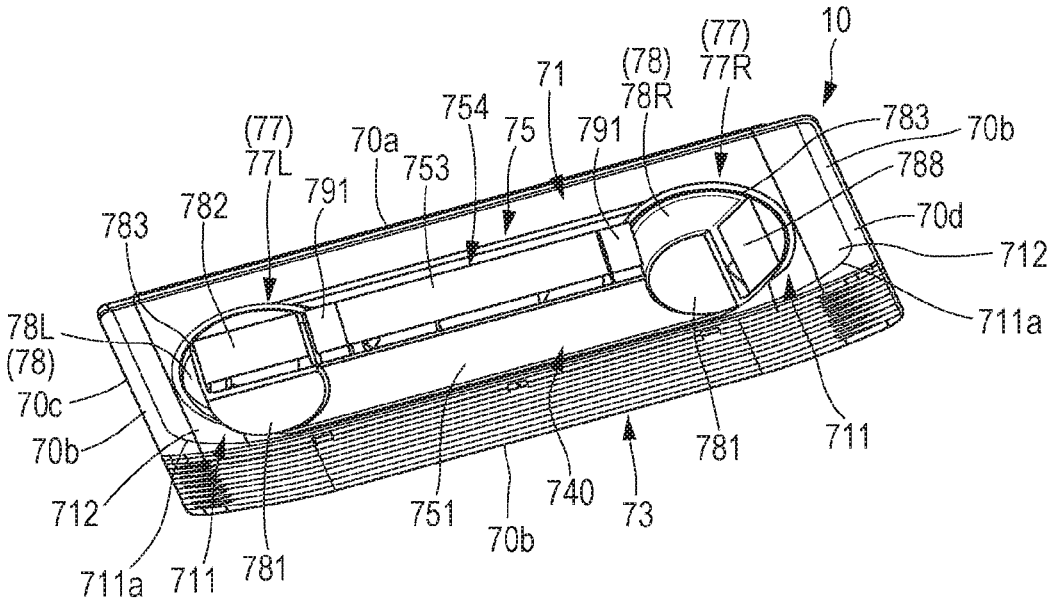
FIG. 13 is a perspective view of FIG. 12.

As can be seen from the perspective view of FIG. 13, the top surface (bottom surface) 751 of the fixed air blowing portion 75 and the top surface (bottom surface) 781 of the rotation unit 78 are always on the same surface even when the rotation unit 78 is rotated. Therefore, the design is improved.

The fixed air blowing portion 75 has a first air blowing opening 754 opening toward the long side (specific side) 70*a*, a Left/right airflow direction vane 752 (see FIG. 15) is provided in the first air blowing opening 754, and a up/down airflow direction vane 753 is provided on the front surface side.

The movable air blowing portion 77 has a second air blowing opening 783 in a part of the side surface of the rotation unit 78, and the second air blowing opening 783 is provided with an up/down airflow direction vane 782. Since the left and right airflow directions can be changed by the rotation of the rotation unit 78, the movable air blowing portion 77 does not need a left/right airflow direction vane. The first air blowing opening 754 of the fixed air blowing portion 75 and the second air blowing opening 783 of the movable air blowing portion 77 are opened along the inclined surfaces (side surfaces) having the same inclination angle in order to give these air blowing openings 754 and 783 a unified design.

While the air blowing direction of the fixed air blowing portion 75 is the direction of the long side 70*a*, the movable air blowing portion 77 rotates between a first position where the second air blowing opening 783 faces the long side 70*a* and a second position to face the short sides 70*c* and 70*d*.

Figure 11:
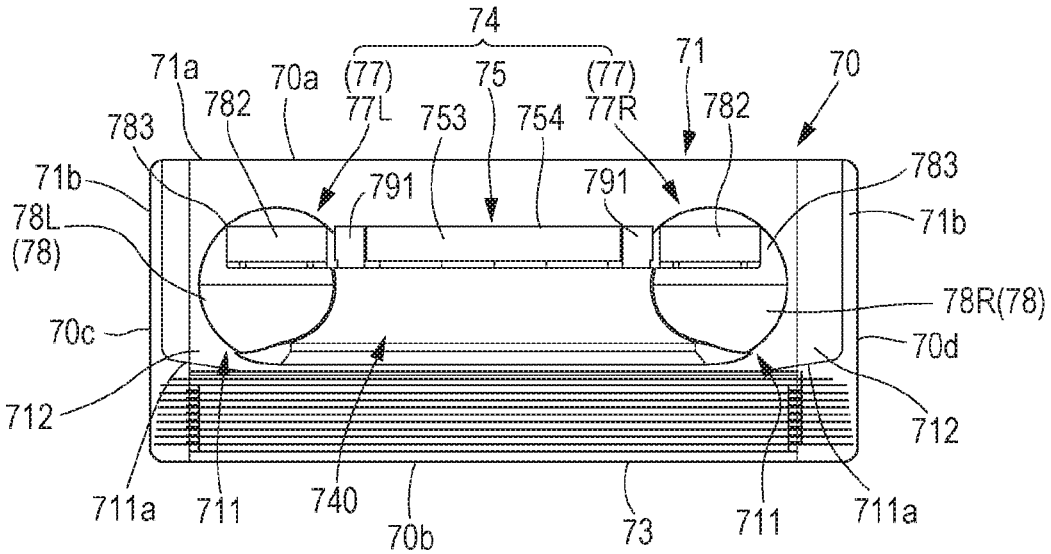
FIG. 11 is a bottom view of the decorative panel when the operation is stopped, as seen from the air conditioning room side.

As illustrated in FIG. 11, when the movable air blowing portion 77 is at the first position, the first air blowing opening 754 and the second air blowing opening 783 are disposed linearly. In this case, it is preferable to provide dummy flaps 791 and 791 on both sides of the first air blowing opening 754 in order to make the appearance such that the first air blowing opening 754 and the second air blowing opening 783 are continuous. This dummy flap 791 is also disposed on the same inclined surface as the first air blowing opening 754 and the second air blowing opening 783.

Figure 12:
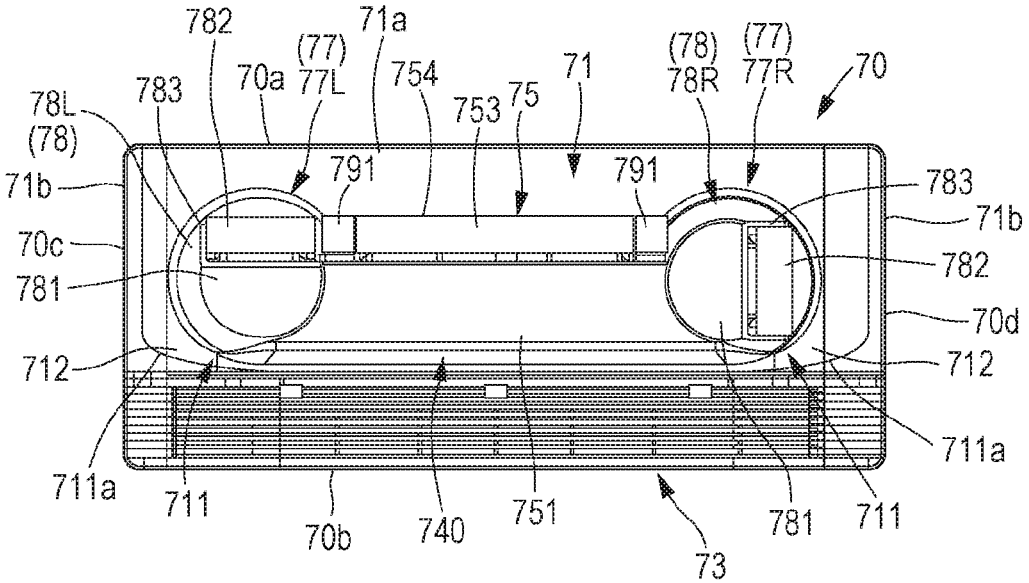
FIG. 12 is a bottom view of the decorative panel during operation as seen from the air conditioning room side.

FIGS. 12 and 13 illustrate a state in which the left movable air blowing portion 77L is at the first position and the right movable air blowing portion 77R is at the second position facing the short side 70*d*. In this way, since the movable air blowing portion 77 is rotatable, the indoor unit 1 is an omnidirectional (multidirectional) blowout type except the direction of the rear long side 70*b*.

Further, as illustrated in FIGS. 12 and 13, even if the second air blowing opening 783 of the movable air blowing portion 77 (77L) is rotated to the second position facing the short side, a feeling of continuity with the first air blowing opening 754 can be obtained in appearance since the portion other than the second air blowing opening 783 is the conical surface. That is, even if the movable air blowing portion 77 is rotated, the basic shape of the air blowing part 74 (the elliptical raised shape) is maintained.

According to this embodiment, the first air blowing opening 754 of the fixed air blowing portion 75 and the second air blowing opening 783 of the movable air blowing portion 77 are formed on the side surfaces of the raised portion 740 which is formed by projecting a part of the panel portion 71 in a trapezoidal cross-section shape toward the air conditioning room R. Therefore, the conditioned air is blown out substantially horizontally from the first air blowing opening 754 and the second air blowing opening 783 along the panel surface of the decorative panel 70, so that the conditioned air can be spread farther.

Further, the conditioned air is simultaneously blown out from the first air blowing opening 754 and the second air blowing opening 783, but it is difficult to make a boundary between the air flow blown out from the first air blowing opening 754 and the air flow blown out from the second air blowing opening 783, and the air conditioning room R can be uniformly conditioned.

Unlike the above embodiment, the first air blowing opening 754 and the second air blowing opening 783 may be opened in a vertical plane orthogonal to the panel surface (or ceiling surface) of the decorative panel 70.

Further, in the above-described embodiment, the fixed air blowing portion 75 and the left and right movable air blowing portions 77 are housed in the elliptical raised portion 740. However, as long as the movable air blowing portion 77 can rotate about the axial line orthogonal to the panel surface of the decorative panel 70 or the surface of the ceiling T1, the movable air blowing portions 77 may be simply disposed on both sides of the fixed air blowing portion 75 without being restricted by the appearance, and such aspects are also included in the invention.

Figure 9:
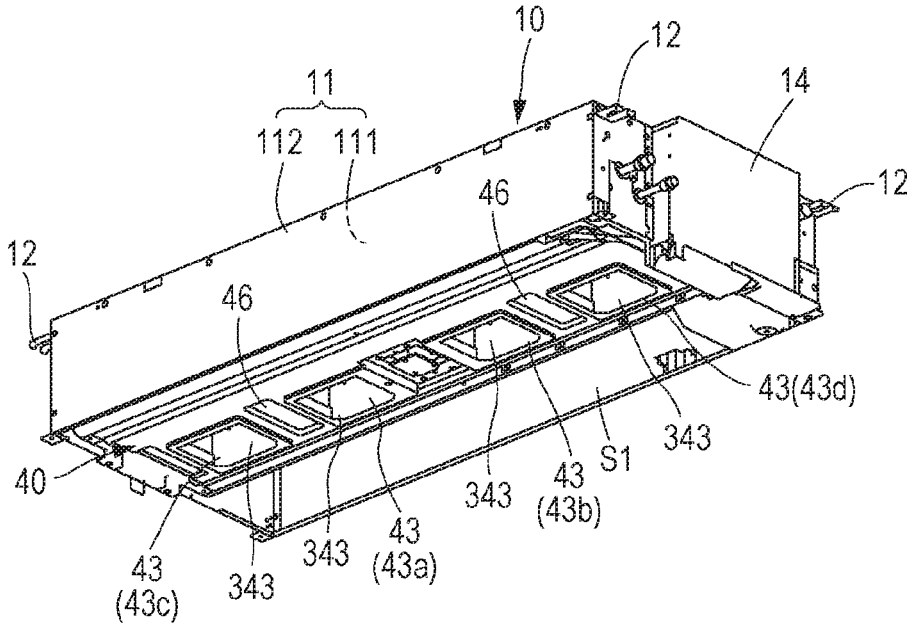
FIG. 9 is a bottom surface side perspective view of a main unit included in the ceiling-embedded air conditioner.
Figure 14:
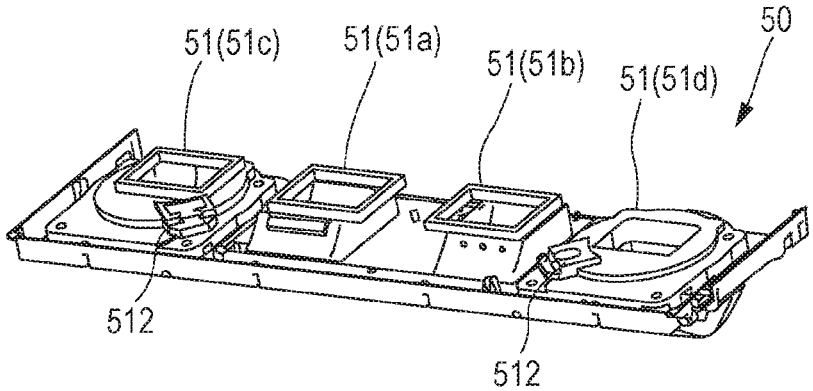
FIG. 14 is a perspective view illustrating a partition plate unit attached to the rear surface side of the decorative panel.

The partition plate unit 50 illustrated in FIG. 14 is attached to the rear surface side of the decorative panel 70. Referring also to FIGS. 4, 9 and the like, the partition plate unit 50 includes four ducts 51 (51*a* to 51*d*) on the upper surface side (the surface facing the drain pan 40), which are respectively fitted to four ventilation holes 43 (43*a* to 43*d*; see FIG. 9) formed in the drain pan 40 to communicate with the blower 343 of the fan unit 30.

The inner two ducts 51*a* and 51*b* are fitted into the corresponding ventilation holes 43*a* and 43*b*, and the two ducts 51*c* and 51*d* disposed outside are fitted into the corresponding ventilation holes 43*a* and 43*b*.

Figure 15:
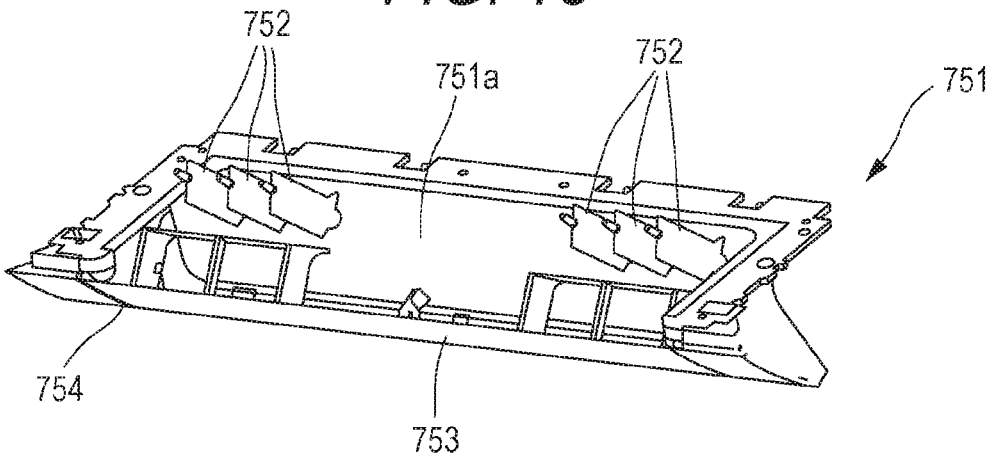
FIG. 15 is a perspective view illustrating a central air blowing unit attached to the partition plate unit.

The ducts 51*a* and 51*b* are ducts for the fixed air blowing portion 75, and as illustrated in FIG. 15, a central air blowing unit 751 having one chamber 751*a* allocated across the ducts 51*a* and 51*b* is attached on the lower surface side (on the surface side facing the rear surface of the decorative panel 70) of the partition plate unit 50.

The left/right airflow direction vane 752 is provided in the chamber 751*a*. Further, the first air blowing opening 754 is formed on the front surface side of the central air blowing unit 751, and the up/down airflow direction vane 753 is provided therein.

Although not illustrated, a motor for driving the left/right airflow direction vane 752 is disposed on the back surface of the chamber 751*a*, and a motor for driving the up/down airflow direction vane 754 is disposed beside the first air blowing opening 754.

The outer ducts 51*c* and 51*d* are ducts for the movable air blowing portion 77, and as illustrated in FIG. 16, the rotation unit 78L of the left movable air blowing portion 77L is rotatably attached to the lower end of the left duct 51*c*. The rotation unit 78R of the right movable air blowing portion 77R is rotatably attached to the lower end of the right duct 51*d*.

Both the rotation units 78L and 78R are driven by a motor. The motor that drives the rotation unit 78 is disposed in a motor cover 512 illustrated beside the outer ducts 51*c* and 51*d* in FIG. 14.

In this embodiment, the rotation units 78L and 78R are respectively rotatable from the first position to the position of 90° or more, for example, 100° as the second position. However, when the rotation units are rotated to such a position, a short circuit phenomenon may occur in which the blown air is sucked into the air suction part 73 without going to the air conditioning room R.

To prevent this, referring to FIGS. 11 to 13, a wall 711 is provided between the rotation unit 78 and the air suction part 73.

In this embodiment, the wall 711 is formed in a slope shape in which a part of the panel portion 71 around the rotation unit 78 rises up from the short sides 70*c* and 70*d* to the height of the top surface 781 of the rotation unit 78 or the height of the air suction part 73 to face between the rotation units 78L and 78R and the air suction part 73. In FIGS. 11 to 13, it is illustrated that a ridge 711*a* of the wall 711 has a slope shape.

According to this, the short circuit phenomenon when the rotation unit 78 is rotated to the vicinity of the maximum rotation position by the wall 711 is prevented, and the blown air flow reaches farther along a slope surface 712 of the wall 711. That is, the wall 711 not only prevents the short circuit phenomenon, but also serves as an airflow guide surface that allows the blown air to reach farther by providing the slope surface 712.

According to this embodiment, since the air blown out from the first air blowing opening 754 and the second air blowing opening 783 flows along the panel surface of the decorative panel 70, the remaining panel surface except for the air suction part 73 of the decorative panel 70 acts as an airflow guide surface including the slope surface 712 of the wall 711.

As described above, the decorative panel 70 is attached to the main unit 10 by fitting the side wall 72 into the bottom surface opening of the main unit 10 and screwing. At the time of this assembly, as illustrated by the arrow in FIG. 6, an air guide path L is formed between the drain pan 40 and the decorative panel 70 to guide a part of the air sucked from the air suction part 73 to the second air suction chamber S2.

In this air guide path L, the air heading for the second air suction chamber S2 passes between the ducts 51 and 51, but in order to secure a larger amount of ventilation, as illustrated in FIG. 9, a recess 46 is formed on the bottom portion of the drain pan 40 corresponding to between the ducts 51 and 51.

Assembly

Next, the assembly of the indoor unit 1 will be described. In the main unit 10, first, the top plate 111 side of the outer trunk 11 is placed on an assembly table, and the heat insulating material 13 is fitted inside the outer trunk 11. Then, a gas connecting pipe and a liquid connecting pipe (both not illustrated) of the assembled heat exchanger 20 (the heat exchanger in which the front heat exchange part 20L and the rear heat exchange part 20R are connected by the connecting plate 21) are pulled out from the side plate 113. In this state, the heat exchanger 20 is fixed to the top plate 111 via a predetermined fixture (not illustrated). After that, the assembled fan unit 30 is disposed in the air blowing chamber F in the heat exchanger 20 and fixed to the top plate 111 via the motor mounting base 361, the fan fixing part 341, and the like.

Next, the gutter 45 on the drain sheet 42 side of the drain pan 40 is fitted to the bottom surface of the outer trunk 11 in alignment with the lower ends of the heat exchange parts 20L and 20R. At this time, the blower 343 of the fan casing 34 is fitted into the ventilation hole 43 of the drain pan 40.

The main unit 10 assembled as described above and the decorative panel 70 are individually packaged and transported to the installation site. The main unit 10 is installed on the ceiling back space T2 by being suspended by a plurality of hanging bolts embedded in the ceiling back space T2 in advance.

Then, the decorative panel 70 is attached from the air conditioning room R side. At this time, the duct 51 of the partition plate unit 50 is connected to the blower 343 of the fan casing 34. Although not illustrated, the indoor unit 1 can be operated by connecting a refrigerant pipe, a power supply line, and a signal line to the outdoor unit.

Operations

When the indoor unit 1 is stopped, as illustrated in FIG. 11, the rotation units 78L and 78R of the movable air blowing portions 77L and 77R are set to the initial position such that their second air blowing openings 783 are oriented in the same direction (long side 70*a*) as the first air blowing opening 754 of the fixed air blowing portion 75 (first position), and both the first air blowing opening 754 and the second air blowing opening 783 are closed by the up/down airflow direction vanes 782 and 753.

Then, the compressor and the fan motor (both not illustrated) of the outdoor unit and the fan motor 36 of the indoor unit 1 start operating in response to a user command from a remote controller (not illustrated) or a command from the air conditioning system.

In the indoor unit 1, the blowing fan 31 rotates by the operation of the fan motor 36. Due to the rotation of the blowing fan 31, the air in the blower 34 of the blowing fan 31 is blown out, so that the inside of the air blowing chamber F becomes a negative pressure, and the air K in the air conditioning room R is sucked from the air suction part 73 provided in the decorative panel 70.

Figure 6:
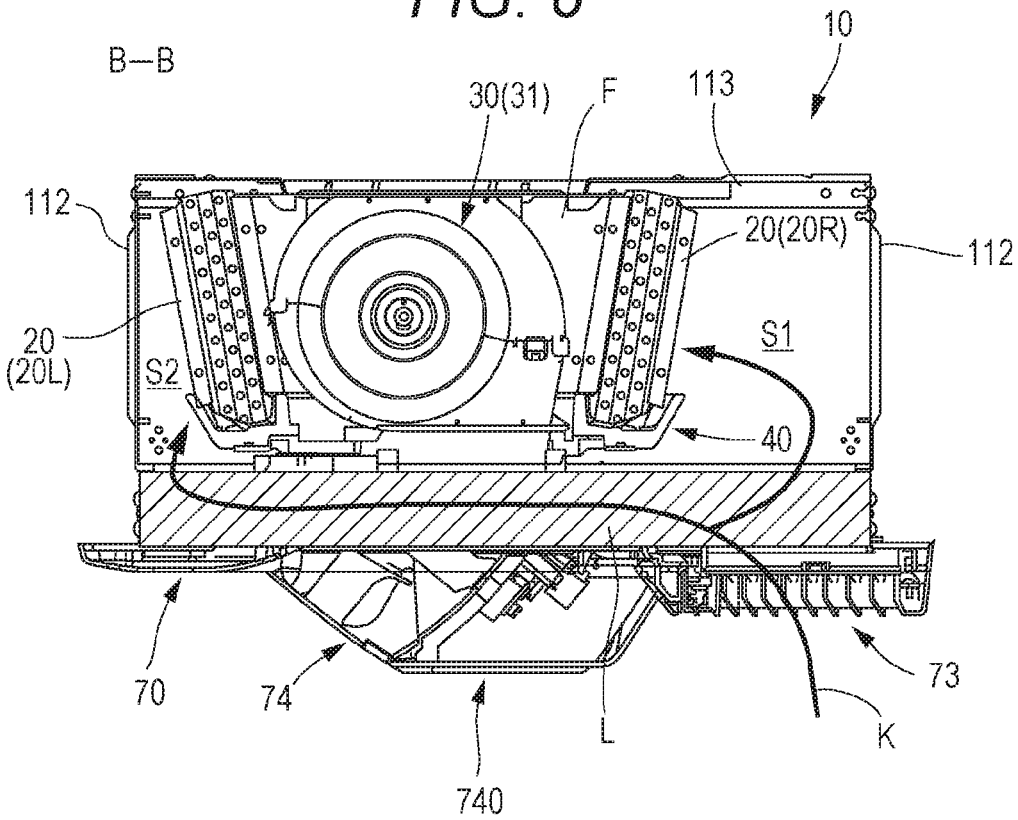
FIG. 6 is a schematic cross-sectional view taken along the line B-B of FIG. 2.
Figure 7:
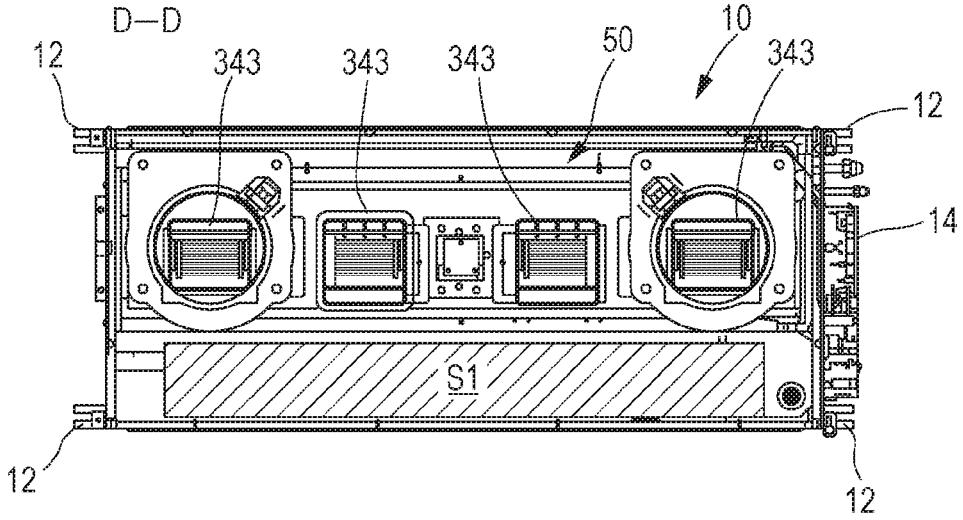
FIG. 7 is a schematic cross-sectional view taken along the line D-D in FIG. 4.
Figure 8:
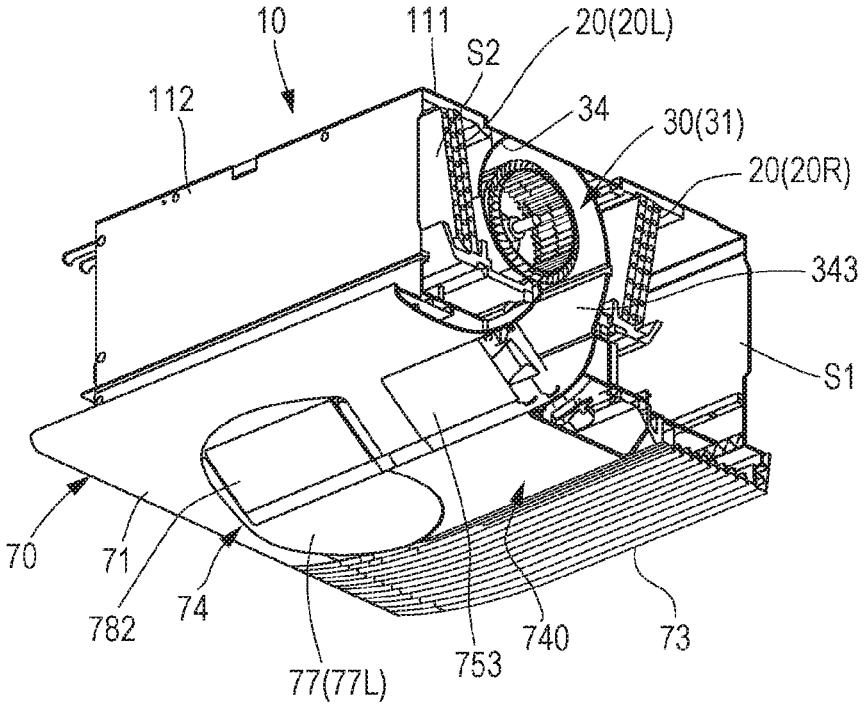
FIG. 8 is a perspective cross-sectional view taken along the line B-B of FIG. 2.

Referring to FIG. 6, the air K sucked from the air suction part 73 flows into the first air suction chamber S1 and also flows into the second air suction chamber S2 through the air guide path L. The air in the first air suction chamber S1 passes through the rear heat exchange part 20R, is heat-exchanged with the refrigerant, and enters the air blowing chamber F. Similarly, the air in the second air suction chamber S2 passes through the front heat exchange part 20L, is heat-exchanged with the refrigerant, and enters the air blowing chamber F.

The air thus conditioned is sent out by the rotation of the blowing fan 31 from the blower 343 of the fan casing 34 toward the fixed air blowing portion 75 and the movable air blowing portion 77 of the decorative panel 70 through the duct 51.

The conditioned air sent to the fixed air blowing portion 75 is blown out from the first air blowing opening 754 in the direction guided by the left/right airflow direction vane 752 and the up/down airflow direction vane 753. In addition, the conditioned air sent to the movable air blowing portion 77 is blown out in the rotation direction of the rotation unit 78 and the direction guided by the up/down airflow direction vane 782.

Since the rotation units 78L and 78R can individually control the rotation, the conditioned air can be supplied in multiple directions except the direction of the long side 70*b* on the rear side where the air suction part 73 is provided, according to the user's request.

Suction Grille

Next, some embodiments of the suction grille 80 attached to the air suction part 73 will be described.

Figure 17:
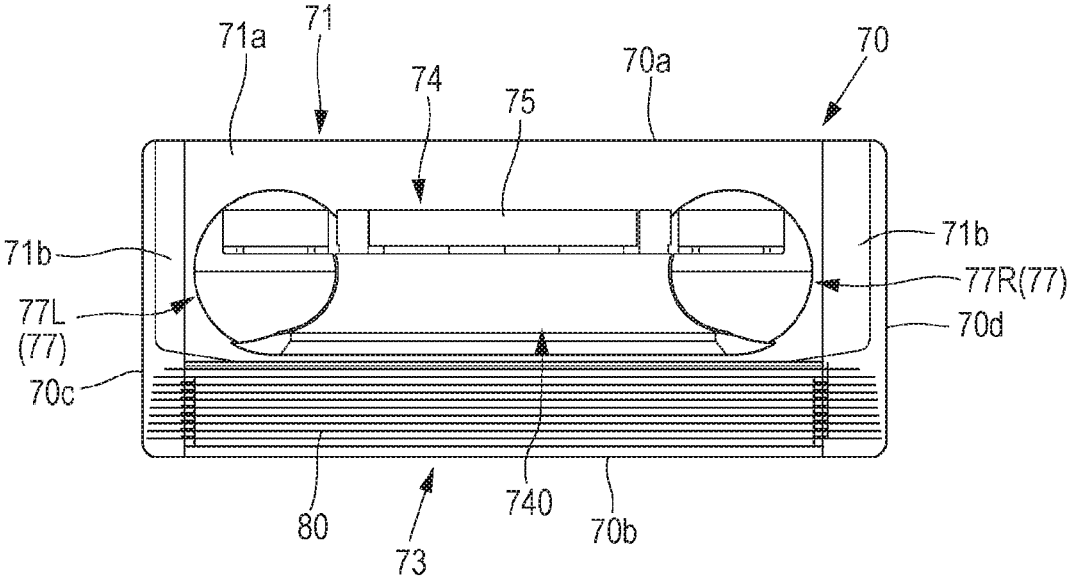
FIG. 17 is a bottom view similar to FIG. 11 of the decorative panel viewed from the air conditioning room side.

First, as illustrated in FIG. 17, the panel portion 71 of the decorative panel 70 includes a panel body 71*a* having the air suction part 73 and the air blowing part 74, and two side panels 71*b* attached to both sides of the panel body 71*a*.

A suction grille 80 having an air filter on the rear surface side is attached to the air suction part 73 so that at least one of opening and closing and attachment and detachment is possible. A plurality of grille bars 81 is provided on the suction grille 80 along the long sides 70*a* and 70*b* of the panel portion 71 so as to be parallel to each other.

Corresponding to this, a dummy bar 82 is also formed on the extension of the grille bar 81 on the side of the side panel 71*b*, but in this state, a gap Da between the abutting portions of the panel body 71*a* and the side panel 71*b* will appear as a linear division line, which causes deterioration in appearance quality. The dummy bar is a bar that is closed by a panel material between bars and does not have a slit-shaped ventilation opening.

Figure 18:
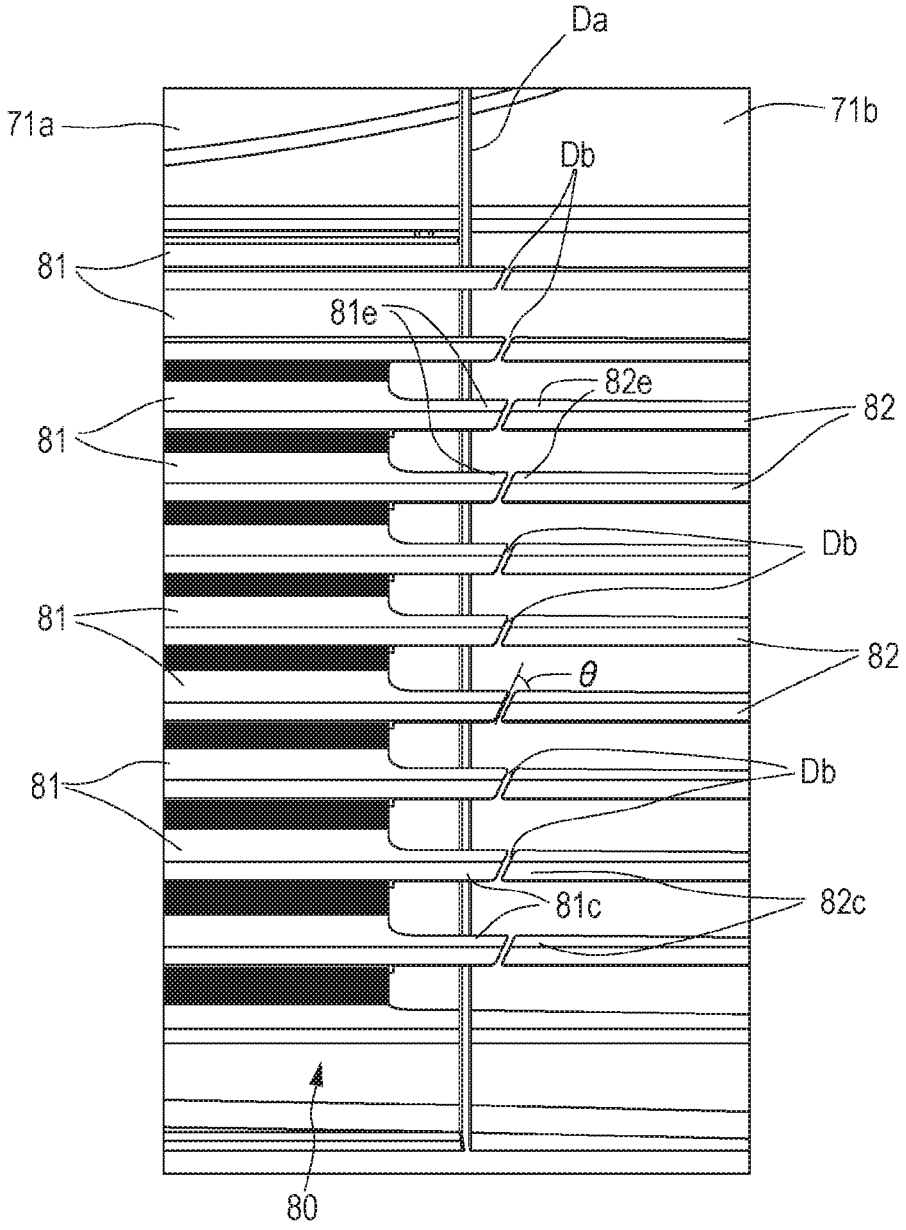
FIG. 18 is an enlarged plan view of an essential part illustrating a first configuration example of a grille bar provided in the air suction part.

Therefore, in this embodiment, as illustrated in FIG. 18, an end 81*e* of each grille bar 81 is extended to the side panel 71*b* side beyond the gap Da, and an end 82*e* of the dummy bar 82 on the side panel 71*b* side is retracted as that extended amount in the direction of the short sides 70*c* and 70*d*, and a gap Db between the abutting portions of the end 81*e* and the end 82*e* is displaced from the gap Da.

According to this, when the decorative panel 70 installed on the ceiling surface is obliquely looked up from the position of the user in FIG. 1, a part of the gap Da is hidden by the grille bar 81, the background of the side panel 71*b* is visible in the gap Db, and the black shadow of the gap Db becomes thin. Therefore, the existence of the gap Da becomes difficult to understand, and the grille bar 81 and the dummy bar 82 can be seen as being connected to each other, and the appearance quality is improved.

Further, as a preferred mode, the gap Db between the abutting portions of the end 81*e* of the grille bar 81 and the end 82*e* of the dummy bar 82 is not parallel to the gap Da between the abutting portions of the panel body 71*a* and the side panel 71*b*, and is set to form a predetermined inclination angle θ with respect to the gap Da. In addition, each of the gaps Db is disposed at the same position in the vertical direction with the inclination angle θ, for example, each gap Db is arranged along a straight line parallel to the division line of the gap Da. Therefore, the gap Db can be made less conspicuous.

Figure 19:
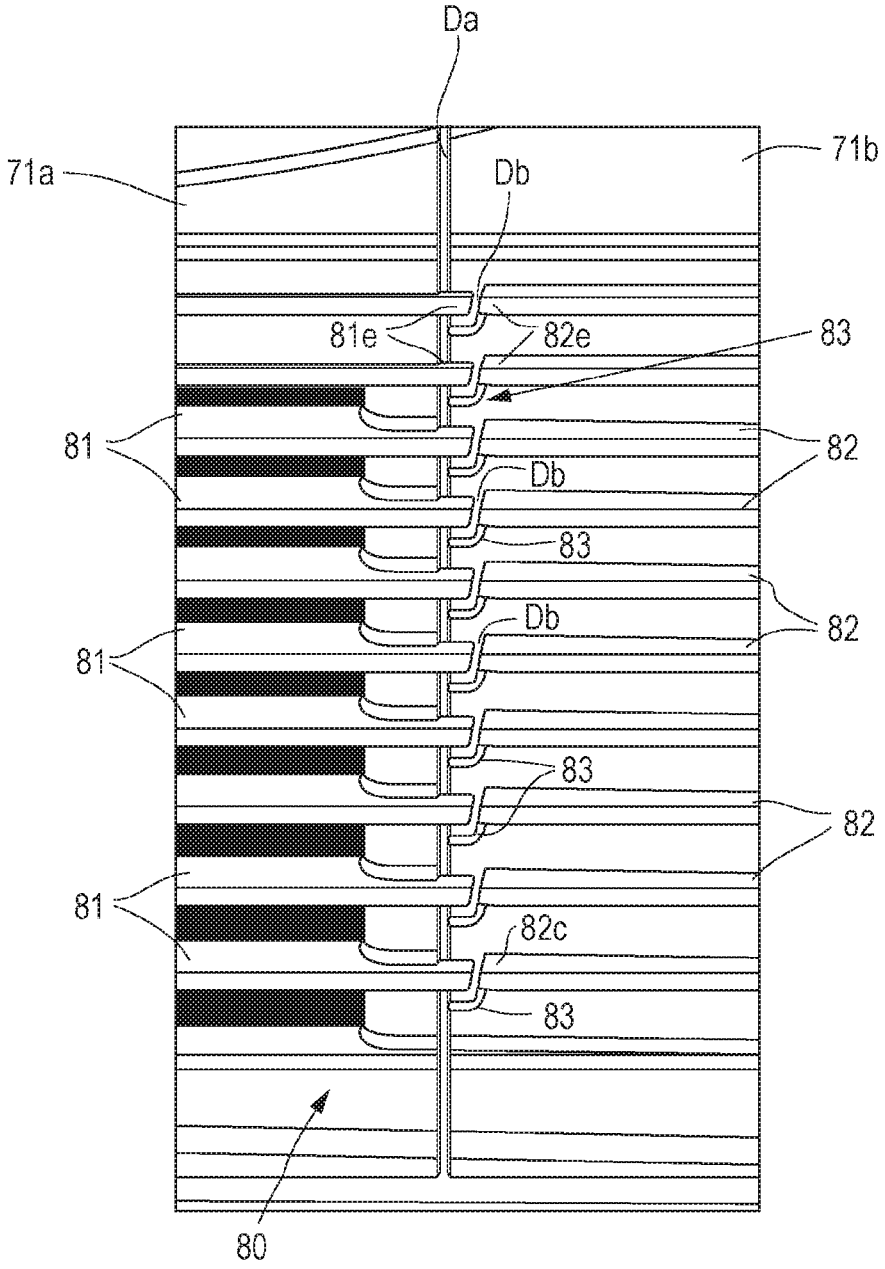
FIG. 19 is an enlarged plan view of an essential part illustrating a preferred aspect of the first configuration example.

More preferably, as illustrated in FIG. 19, even if the width of the gap Db is widened by forming a rib 83 on the rear side of the gap Db from the end 82*e* of the dummy bar 82 to reach the gap Da, the gap Db can be made more inconspicuous.

The rear side of the gap Db is the rear side of the gap Db when the decorative panel 70 installed on the ceiling surface is obliquely looked up from the position of the user in FIG. 1. Further, in FIGS. 18 and 19, the darkened portion is the ventilation opening of the suction grille 80.

Next, referring to FIG. 20, a preferable pitch arrangement of the grille bars 81 included in the suction grille 80 will be described.

Referring again to FIG. 6, in the indoor unit 1 according to this embodiment, as the heat exchanger 20 in the main unit 10, there is the front heat exchange part 20L on the left side and the rear heat exchange part 20R on the right side in FIG. 6, the first air suction chamber S1 is provided on the rear heat exchange part 20R side, and the second air suction chamber S2 is provided on the front heat exchange part 20L side.

On the other hand, since the air suction part 73 is disposed on the rear side (long side 70*b*) of the decorative panel 70, the air sucked from the air suction part 73 easily flows into the first air suction chamber S1, and passes through the air guide path L in the second air suction chamber S2, so that the ventilation resistance is increased as that much.

Thereby, in the opening range of the suction grille 80 attached to the air suction part 73, a portion with a large suction amount and a portion with a small suction amount can be formed due to the relationship with the above-described arrangement of the air suction chambers S1 and S2. Speaking in FIG. 6, the suction amount is relatively small on the front side of the suction grille 80 (the side close to the air guide path L), and the suction amount gradually increases toward the rear side (the long side 70*b*).

Therefore, if the grille bars 81 are evenly disposed in the opening of the suction grille 80, the opening areas are evenly divided, the opening areas tend to be insufficient in the portions with a large suction amount, and the opening areas are excessive in the portions with a small suction amount.

Figure 20:
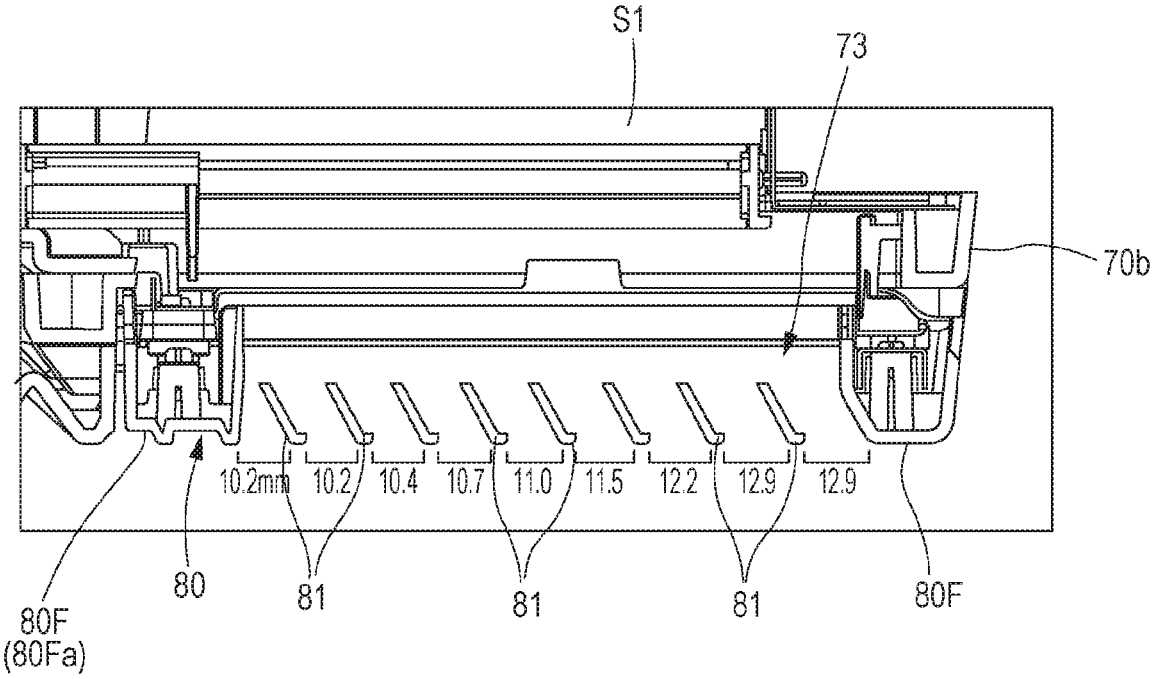
FIG. 20 is an enlarged cross-sectional view of an essential part illustrating a second configuration example of the grille bar provided in the air suction part.

Therefore, in this embodiment, as illustrated in FIG. 20, when a plurality of grille bars 81 is provided in the suction grille 80 in parallel with each other along the long side 70*b* of the decorative panel 70, the opening area is made large in the portion where the suction amount is large. However, the opening area is made small in the portion where the suction amount is small.

That is, the gap between the grille bars 81 is narrowed on the front side of the suction grille 80, and the gap between the grille bars 81 is widened toward the rear side. As an example, as illustrated in FIG. 20, the gap between the grille bars 81 is gradually widened as 10.2 mm, 10.4 mm, 10.7 mm, 11.0 mm, 11.5 mm, 12.2 mm, and 12.9 mm as going from the front side to the rear side of the suction grille 80.

In this way, the air is efficiently sucked into the opening area, so that the suction capacity is improved by changing the gap between the grille bars 81 depending on the portion where the suction amount of air is large and the portion where the suction amount is large.

However, if the gap between the grille bars 81 is changed abruptly, the rows of the grille bars 81 will be rattled and the appearance quality will be degraded. Therefore, the gap is made gradually increased from the front to the rear, so that there will be less change and it look like an equal gap.

Next, some configurations of the switch operated when opening and closing the suction grille 80 will be described using FIGS. 21(*a*) to 24(*b*). This switch is included in the grille surface together with the grille bar 81 and is inconspicuous in appearance, but has a feature that it can be easily operated by a finger.

First, referring to FIG. 20 described above, the suction grille 80 includes a base frame 80F that fits into the opening of the air suction part 73. Although FIG. 20 is a cross-sectional view, as described above, since the opening of the air suction part 73 is quadrangular, the base frame 80F is also quadrangular. Further, as described above, the plurality of grille bars 81 is formed in parallel with each other along the extending direction of the long side 70*b* of the decorative panel 70 in this example in the base frame 80F.

Figure 21:
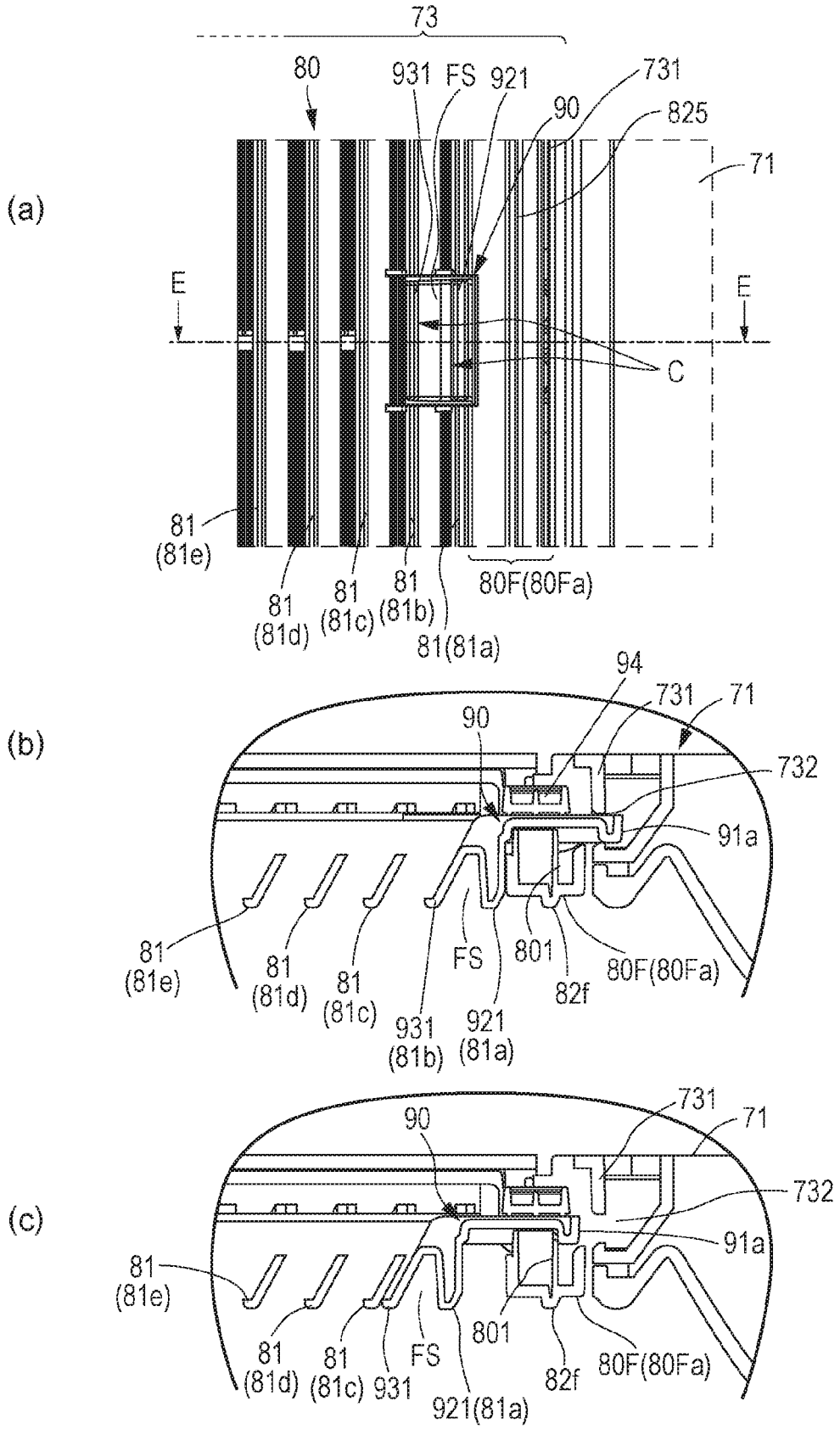
FIG. 21(*a*) is a bottom view illustrating the portion where the switch for opening and closing a suction grille is attached when viewed from the air conditioning room side, FIG. 21(*b*) is a cross-sectional view taken along line E-E of FIG. 21(*a*) when the switch is at a lock position, and FIG. 21(*c*) is a cross-sectional view taken along line E-E of FIG. 21(*a*) when the switch is at an unlock position.

As illustrated in FIGS. 21(*a*) and 21(*b*), in this embodiment, a switch 90, which is operated when the suction grille 80 opens or closes, is provided in a frame (open/close side frame) 80Fa of the base frame 80F on the opening/closing side near the air blowing part 74.

The switch 90 is slidable in a direction orthogonal to the grille bar 81, and is disposed at, for example, two or three positions. FIG. 21(*a*) illustrates the bottom surface of one of the locations viewed from the air conditioning room R.

Further, a decorative dummy bar 82*f* having no ventilation opening is formed in the open/close side frame 80Fa in order to unify the appearance with the grille bar 81. Although not illustrated, the frame on the side opposite to the open/close side frame 80Fa is connected to the edge of the air suction part 73 by a hinge or the like.

Figure 22:
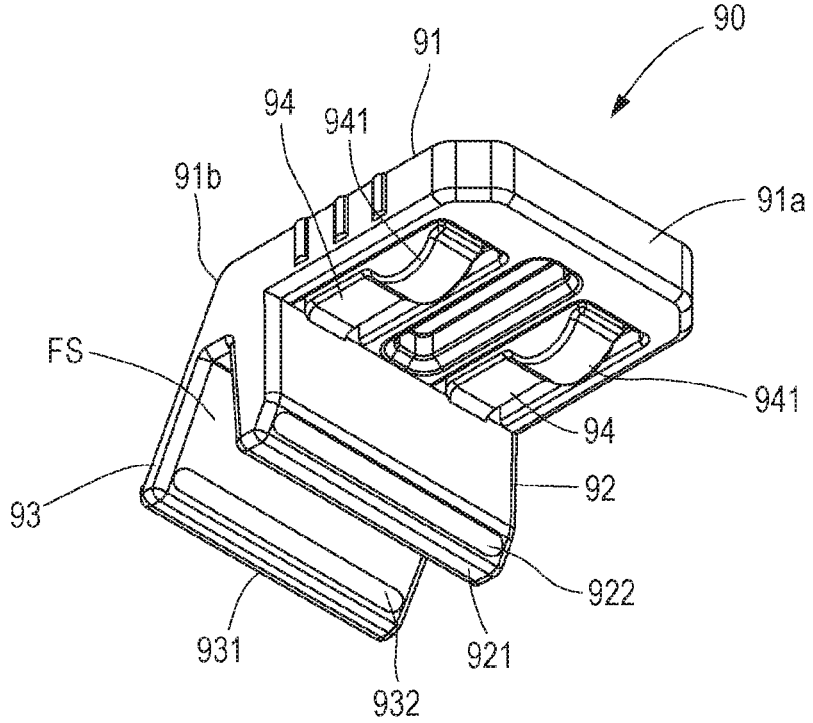
FIG. 22(*a*) is a perspective view illustrating the switch viewed from above, and FIG. 22(*b*) is a side view.
Figure 22:
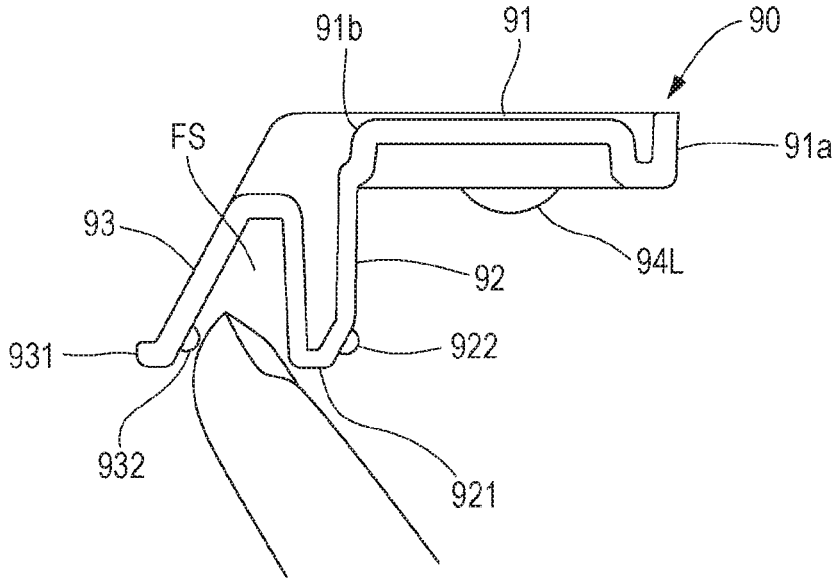

Referring to FIGS. 22(*a*) and 22(*b*), the switch 90 has a base plate 91 slidably held in a part of the open/close side frame 80Fa. A tip end 91*a* of the base plate 91 protrudes and retracts, with the sliding of the switch 90, in an engagement hole 732 which is projected in an inner edge 731 of the air suction part 73.

At the rear end 91*b* of the base plate 91, a knob piece 92 and a finger hook piece 93 are provided. The knob piece 92 is bent substantially vertically downward from the rear end 91*b* of the base plate 91 toward the air conditioning room R side.

On the other hand, the finger hook piece 93 is formed to face the knob piece 92 in an oblique direction (an obliquely left lower direction in FIG. 22(*b*)) so as to form a gap FS which is formed with respect to the knob piece 92 to insert a fingertip.

The switch 90 is provided such that the base plate 91 is slidably held by the pressing member 94 on the open/close side frame 80Fa. As illustrated in FIG. 22(*a*), two flat springs 94 made of a strip plate having a semicircular protruding curved portion 941 are disposed side by side on the bottom surface side of the base plate 91 in this example.

On the other hand, on the open/close side frame 80Fa, a rib plate 801 which is overridden by the protruding curved portion 941 of the flat spring 94 as the switch 90 slides is provided upright.

According to this, when the protruding curved portion 941 gets over the rib plate 801, a predetermined click force is generated. The switch 90 is selectively held at a lock position (a position where a tip end 911 of the base plate 91 is engaged with the engagement hole 732) illustrated in FIG. 21(*b*) and an unlock position (a position where the tip end 911 of the base plate 91 comes out and off from the engagement hole 732) illustrated in FIG. 21(*c*).

As the switch 90 is slidably attached to the open/close side frame 80Fa, in this first example, partial portions of the first grille bar 81*a* adjacent to the open/close side frame 80Fa and the second grille bar 81*b* adjacent thereto are cut by a length corresponding to the width of the switch 90. In the present specification, this cut-out portion is referred to as a "cut-out bar", and is denoted by the symbol C.

In order to make up for the cut-out bar in appearance, a complementary dummy bar 921 is formed in the same shape as that of the first grille bar 81*a* in a sense of complementing the lower edge of the knob piece 92 in shape, and a complementary dummy bar 931 is formed in the same shape as that of the second grille bar 81*b* in a sense of complementing the lower end of the finger hook piece 93 in shape. When the switch 90 is at the lock position illustrated in FIG. 21(*b*), the complementary dummy bar 921 of the knob piece 92 is located at the cut-out bar C of the first grille bar 81*a*, and the complementary dummy bar 931 of the finger hook piece 93 is located at the cut-out bar C of the second grille bar 81*b*.

According to this, in the locked state, the knob piece 92 and the finger hook piece 93 of the switch 90 are both included in a part of the grille bar 81 and do not project from the grille surface, so that the appearance quality is improved.

Since a gap-shaped division line is visually recognized between the cut-out bar C of each of the grille bars 81*a* and 81*b* and the switch 90, when the decorative panel 70 is looked up from the air conditioning room R, it is possible to easily recognize the position where the switch 90 is located.

Further, since there is the gap FS for inserting a fingertip between the knob piece 92 and the finger hook piece 93, it is possible to put the fingertip in this gap FS and easily move the switch 90 to the unlock position illustrated in FIG. 21(*c*) (the same applies when returning the switch 90 to the lock position illustrated in FIG. 21(*b*).

In the unlock position illustrated in FIG. 21(*c*), the knob piece 92 is located in the cut-out bar of the second grille bar 81*b*, and the finger hook piece 93 abuts on the third grille bar 81*c*. That is, the distance between adjacent grille bars 81 becomes the moving stroke of the switch 90.

In order to make it difficult for the fingertip to slip on the finger hook piece 93, a rib 932 may be provided on the lower end edge side of the inner surface of the finger hook piece 93, as illustrated in FIGS. 22(*a*) and 22(*b*). Further, it is preferable that the knob piece 92 is also provided with a rib 922 for making it difficult for the fingertip to slip. Instead of the rib, for example, a plurality of hemispherical protrusions may be formed.

Figure 23:
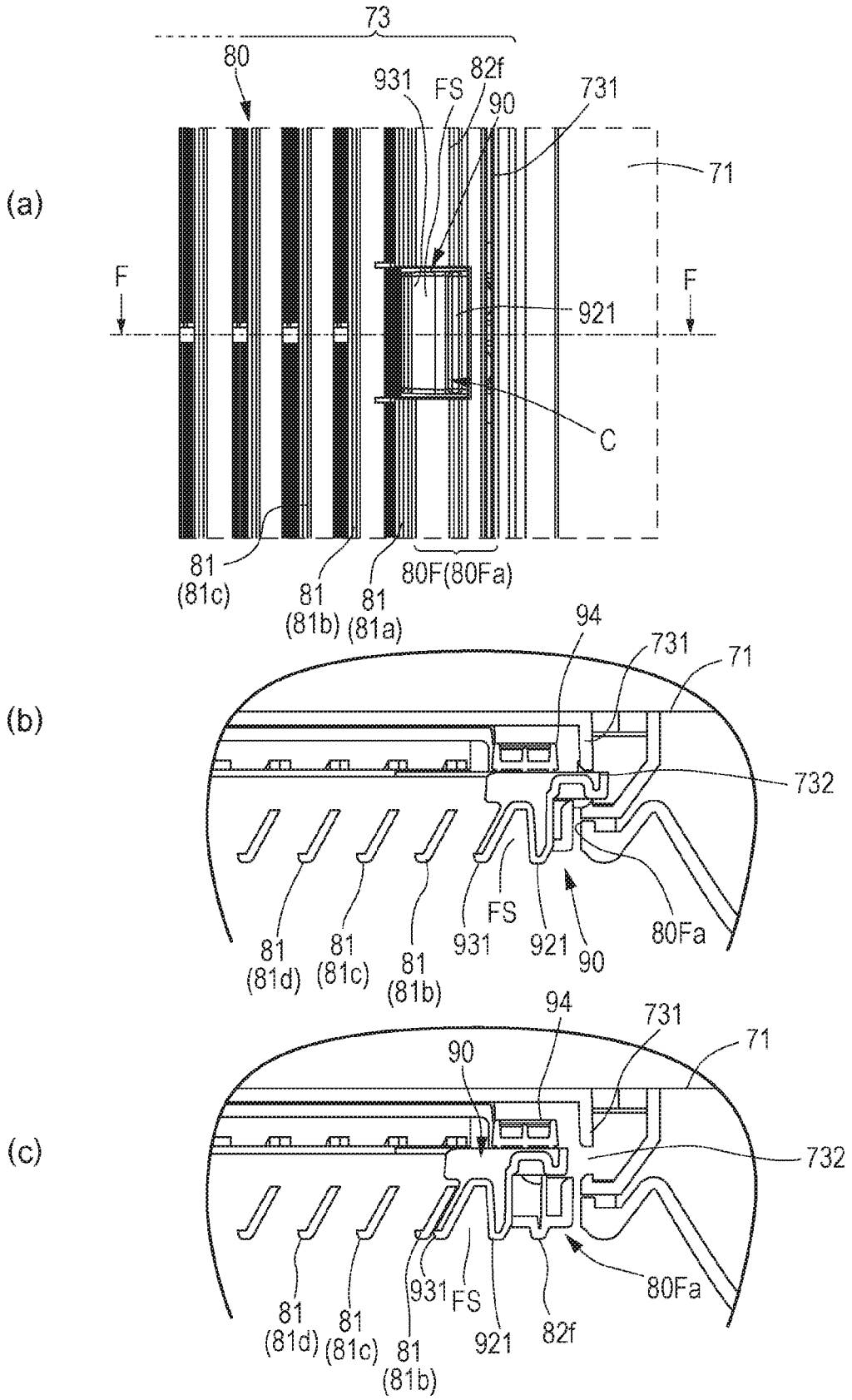
FIGS. 23(*a*) to 23(*c*) are an example of changing a mounting position of the above switch, similarly to FIGS. 21(*a*) to 21(*c*), FIG. 23(*a*) is a bottom view illustrating the portion where the switch for opening and closing the suction grille when viewed from the air conditioning room side, FIG. 23(*b*) is a cross-sectional view taken along line F-F of FIG. 23(*a*) when the switch is at the lock position, and FIG. 23(*c*) is a cross-sectional view taken along line F-F of FIG. 23(*a*) when the switch is at the unlock position.

As a second example, as illustrated in FIGS. 23(*a*) to 23(*c*), a part of the open/close side frame 80Fa is cut out from the inner edge side, and a part of the switch 90 is inserted into the cut-out portion so that the mounting position of the switch 90 is shifted to the air blowing part 74, so that the knob piece 92 of the switch 90 may be included in the open/close side frame 80Fa.

In this case, as illustrated in the bottom view of FIG. 23(*a*), partial portions of the dummy bar 82*f* and the first grille bar 81*a* of the open/close side frame 80Fa are cut by a length corresponding to the width of the switch 90 to be the cut-out bar C.

Then, at the lock position of the switch 90, the complementary dummy bar 921 at the lower end edge of the knob piece 92 is disposed in the cut-out bar C of the dummy bar 82*f*, and the complementary dummy bar 931 at the lower edge of the finger hook piece 93 is disposed in the cut-out bar C of the first grille bar 81*a*. The other points may be the same as those in the first example.

According to this, similarly to the first example, when locked, the complementary dummy bar 921 of the knob piece 92 of the switch 90 is included in a part of the dummy bar 82*f*, and the complementary dummy bar 931 of the finger hook piece 93 is included in a part of the first grille bar 81 so as not to protrude from the grille surface. Therefore, the appearance quality is improved.

Further, when locked, a part of the ventilation opening between the first and second grille bars 81*a* and 81*b* is blocked by the switch 90 in the first example. However, according to the second example, when locked, the ventilation opening between the first grille bar 81*a* and the second grille bar 81*b* is not blocked by the switch 90.

In this second example, when unlocked, as illustrated in FIG. 23(*c*), the complementary dummy bar 921 formed on the lower end edge of the knob piece 92 is located in the cut-out bar C of the first grille bar 81*a*, and the complementary dummy bar 931 of the finger hook piece 93 abuts on the second grille bar 81*b*.

Next, another embodiment of the switch will be described with reference to FIGS. 24(*a*) and 24(*b*). A switch 90A according to this another embodiment includes only the knob piece 92. Further, the specific frame 80Fa includes a guide surface 85 that moves the switch 90A in an oblique direction. The knob piece 92 is in the grille surface together with the grille bar 81 when locked and its presence is inconspicuous, but it projects downward from the grille surface only when unlocked.

The guide surface 85 of the specific frame 80Fa has a high position on the side of the engagement hole 732 formed in the inner edge 731 of the air suction part 73 and a low position on the side of the first grille bar 81*a*. The guide surface is formed in a sloping surface with a right downward gradient from the high position to the low position in FIGS. 24(*a*) and 24(*b*).

The base plate 91 of the switch 90A is slidably held by the specific frame 80Fa along the guide surface 85. For this holding, for example, the pressing member 94 illustrated in FIG. 21(*b*) above may be used.

The tip end 91*a* of the switch 90A protrudes and retracts in the engagement hole 732 as the switch 90A slides. The knob piece 92 is provided on the rear end 91*b* of the switch 90A. In this case, the knob piece 92 is substantially vertically downward from the rear end 91*b* of the switch 90A in a state where the knob piece 92 is obliquely disposed on the guide surface 85.

Figure 24:
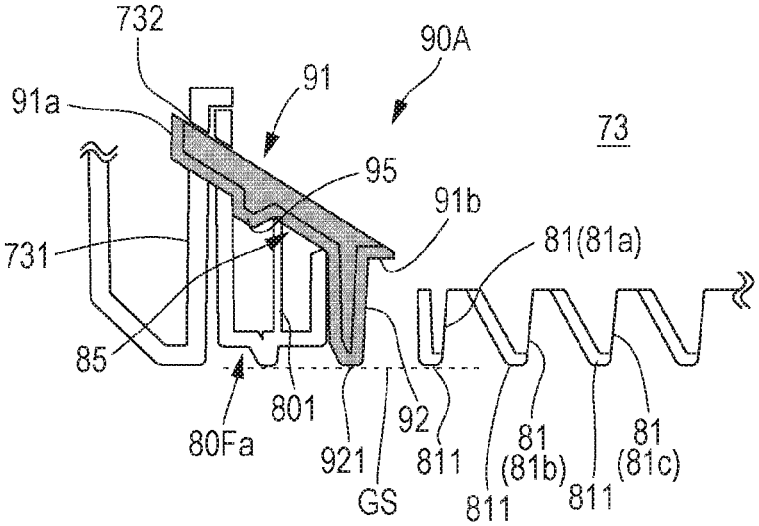
FIG. 24(*a*) is a cross-sectional view illustrating the switch according to another embodiment when the switch is at the lock position, and FIG. 24(*b*) is a cross-sectional view when the switch is at the unlock position.
Figure 24:
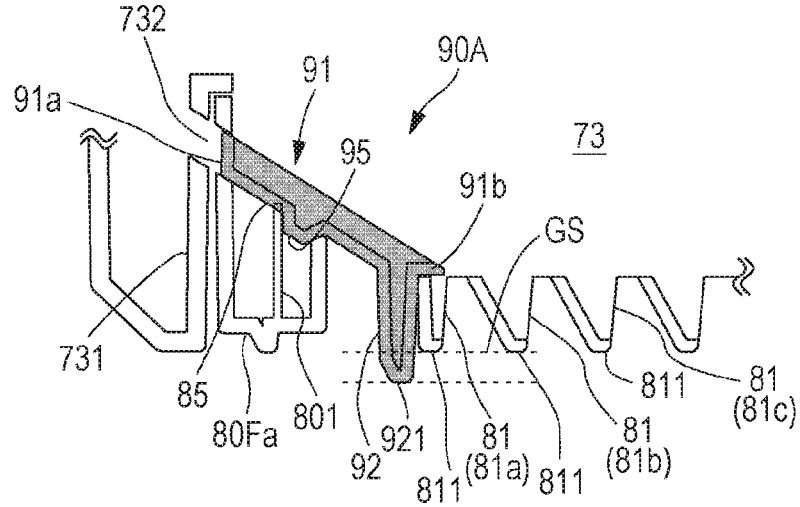

The switch 90A slides between the lock position illustrated in FIG. 24(*a*) where the tip end 91*a* thereof enters the engagement hole 732 and the unlock position illustrated in FIG. 24(*b*) where the tip end 91*a* comes out of the engagement hole 732. In this example, the moving stroke of the switch 90A is defined by the distance between the frame 80Fa and the first grille bar 81*a*.

At the lock position illustrated in FIG. 24(*a*), the length of the knob piece 92 is set such that the lower end edge 921 thereof is at the same height position as a grille surface GS where a lower end edge 811 of each grille bar 81 includes. At the unlock position illustrated in FIG. 24(*b*), the lower end edge 921 is set to a position lower than the grille surface GS, that is, a length protruding downward from the grille surface GS toward the air conditioning room R. The protruding length from the grille surface GS is set so that the tip of the knob piece 92 can be easily grasped with a finger.

According to this, the knob piece 92 is in the grille surface GS including the lower end edge 811 of the grille bar 81 when locked, and its presence is not conspicuous. However, the knob piece 92 protrudes downward from the grille surface GS only when unlocked by sliding the switch 90A diagonally downward, and becomes easy to grip.

Further, also in this other embodiment, the rib plate 801 forming one side of the click force generating mechanism is provided upright toward the guide surface 85 in the frame 80Fa, and a projection 95 forming the other side of the click force generating mechanism is formed on the rear surface side of the base plate 91 of the switch 90A.

In this case, the rib plate 801 is flexible, and the projection 95 bends the tip end of the rib plate 801 as the switch 90A slides to generate a click sound and get over it. As a result, the switch 90A is selectively held in the lock position illustrated in FIG. 24(*a*) and the unlock position illustrated in FIG. 24(*b*).

LIST OF REFERENCE SIGNS

1 Indoor unit
10 Main unit
11 Outer trunk
111 Top plate
112/113 Side plate
12 Mounting bracket
13 Heat insulating material
20 Heat exchanger
20L Front heat exchange part
20R Rear heat exchange part
21 Connecting plate
30 Fan unit
31 Blowing fan
32 Impeller
33 Blowing path
34 Fan casing
343 Blower
35 Rotating shaft
36 Fan motor
40 Drain pan
43 Ventilation hole
45 Gutter
50 Partition plate unit
51 (51*a* to 51*d*) Duct
70 Decorative panel
70*a*/70*b* Long side
70*c*/70*d* Short side
71 Panel portion
71*a* Panel body
71*b* Side panel
711 Wall
72 Side wall
721 Frame
722 Beam
73 Air suction part
74 Air blowing part
740 Raised portion
75 Fixed air blowing portion
751 Central air blowing unit
754 First air blowing opening
77(77L, 77R) Movable air blowing portion
78(78L, 78R) Rotation unit
783 Second air blowing opening
80 Suction grille
80F Base frame
80Fa Open/close side frame
81 (81*a*, 81*b* . . . ) Grille bar
82/82*f* Dummy bar
90 Switch
91 Base plate
92 Knob piece
93 Finger hook piece
1 Connecting portion
R Air conditioning room
T1 Ceiling T2 Ceiling back space
F Air blowing chamber
S1/S2 Air suction chamber
L Air guide path

The invention claimed is:

1. A ceiling-embedded air conditioner, comprising:

a box-shaped main unit that includes an air blower and a heat exchanger and is disposed in a ceiling back space; and a decorative panel that is attached to a bottom surface of the main unit so as to be included in a part of a ceiling surface, the decorative panel being provided with an air suction part disposed on an air suction side of the air blower and an air blowing part disposed on an air sending side of the air blower, wherein the air blowing part is formed with a fixed air blowing portion that includes a first air blowing opening for blowing air toward a specific side of the decorative panel and movable air blowing portions disposed on both sides of the fixed air blowing portion, each of the movable air blowing portions is rotatable within a predetermined angle range about an axis orthogonal to a panel surface of the decorative panel or the ceiling surface, each of the second air blowing openings is directed in a predetermined direction between a first position facing the specific side of the decorative panel and a second position facing another side adjacent to the specific side by the rotation of the movable air blowing portions, the second air openings are not rotatable to face the air suction side so that the movable air blowing portions do not blow air toward the air suction side, and the fixed air blowing portion and the movable air blowing portions are arranged on a same plane.

2. The ceiling-embedded air conditioner of claim 1, wherein each of the movable air blowing portions is rotatable within a predetermined angle range about an axis orthogonal to a panel surface of the decorative panel and the ceiling surface.

3. The ceiling-embedded air conditioner of claim 1, wherein the decorative panel is a rectangle having a pair of long sides facing front and rear and a pair of short sides facing left and right, wherein the air suction part is disposed on the rear long side and the air blowing portion is disposed on the front long side, wherein the specific side of the decorative panel is the front long side of the rectangle; and by rotating the movable air blowing portions, each of the second air blowing openings is directed in the predetermined direction between the first position facing the front long side of the decorative panel and the second position facing the short side adjacent to the front long side, and wherein the second air openings are not rotatable to face the rear long side so that the movable air blowing portions do not blow air toward the rear long side.

4. The ceiling-embedded air conditioner of claim 1, wherein the first air blowing opening is aligned linearly with the second air blowing openings at the first position of the second air blowing opening rotated to face the specific side of the decorative panel.

5. The ceiling-embedded air conditioner of claim 1, wherein each of the air blowing portions include exactly one second air blowing opening.

* * * * *